US009518571B2

(12) United States Patent
Yamaoka et al.

(10) Patent No.: US 9,518,571 B2
(45) Date of Patent: Dec. 13, 2016

(54) SEALED COMPRESSOR

(75) Inventors: Masakazu Yamaoka, Shiga (JP); Yasushi Hayashi, Shiga (JP); Makoto Katayama, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 781 days.

(21) Appl. No.: 13/460,141

(22) Filed: Apr. 30, 2012

(65) Prior Publication Data

US 2012/0288382 A1 Nov. 15, 2012

(30) Foreign Application Priority Data

May 9, 2011 (JP) ..... 2011-103985
Sep. 8, 2011 (JP) ..... 2011-195811
Mar. 21, 2012 (JP) ..... 2012-63351

(51) Int. Cl.
*F04B 35/04* (2006.01)
*F04B 39/10* (2006.01)
(Continued)

(52) U.S. Cl.
CPC ..... *F04B 35/04* (2013.01); *F04B 39/0005* (2013.01); *F04B 39/1066* (2013.01); *F04B 7/0216* (2013.01)

(58) Field of Classification Search
CPC ..... F04B 35/04; F04B 39/0005; F04B 7/04; F04B 39/1066; F04B 1/00; F04B 13/00; F04B 25/00; F04B 27/00; F04B 29/00; F04B 3/00; F04B 35/00; F04B 5/00; F04B 7/00; F04B 9/00
(Continued)

(56) References Cited

U.S. PATENT DOCUMENTS 5,149,254 A * 9/1992 Riffe ..... 417/569
5,346,373 A * 9/1994 Riffe ..... 417/415
(Continued)

FOREIGN PATENT DOCUMENTS

CN 201096070 Y 8/2008
CN 101438059 5/2009
(Continued)

OTHER PUBLICATIONS

Office Action issued in corresponding Japanese Application No. 2012-063351, Sep. 29, 2015, 3 pages.
(Continued)

*Primary Examiner* — Dominick L Plakkoottam
(74) *Attorney, Agent, or Firm* — Hamre, Schumann, Mueller & Larson, P.C.

(57) ABSTRACT

A sealed compressor comprises an electric element; a compression element; and a sealed container accommodating the electric element and the compression element; wherein the compression element includes a cylinder block defining a compression chamber; a piston which is reciprocatable inside the compression chamber; and a valve plate disposed to close an opening end of the compression chamber and having a discharge hole which provides communication between inside and outside of the compression chamber; the piston has a first groove on a tip end surface thereof which faces the valve plate, the first groove having a predetermined width and extending from an outer peripheral edge portion of the tip end surface toward a portion of the tip end surface which faces the discharge hole; and a tip end portion of the first groove is positioned in the portion of the tip end surface which faces the discharge hole and is inclined.

15 Claims, 25 Drawing Sheets

(51) Int. Cl.
*F04B 39/00* (2006.01)
*F04B 7/02* (2006.01)

(58) Field of Classification Search
USPC ..... 417/415
See application file for complete search history.

(56) References Cited

U.S. PATENT DOCUMENTS

| | | | | |
|---|---|---|---|---|
| 5,816,783 | A | 10/1998 | Oshima et al. | |
| 6,293,763 | B1 * | 9/2001 | Yokomachi et al. | 417/269 |
| 7,380,493 | B2 * | 6/2008 | Park et al. | 92/239 |
| D633,529 | S * | 3/2011 | Hamada et al. | D15/7 |
| 2004/0253131 | A1 * | 12/2004 | Park et al. | 417/490 |
| 2009/0175746 | A1 | 7/2009 | Park et al. | |
| 2010/0316515 | A1 * | 12/2010 | Hamada et al. | 417/437 |
| 2012/0014821 | A1 | 1/2012 | Hikichi et al. | |
| 2012/0288382 | A1 * | 11/2012 | Yamaoka et al. | 417/410.1 |

FOREIGN PATENT DOCUMENTS

| | | |
|---|---|---|
| JP | 58-195086 | 11/1983 |
| JP | 4-24627 U | 2/1992 |
| JP | 5-018358 | 1/1993 |
| JP | 6-323251 | 11/1994 |
| JP | 8-6689 B | 1/1996 |
| JP | 2005-214080 | 8/2005 |
| JP | 2010-90705 | 4/2010 |
| JP | 2012-021471 | 2/2012 |

OTHER PUBLICATIONS

Office Action issued in corresponding Chinese Application No. 201210141723.4, Sep. 29, 2015, 17 pages, with an English Translation.

* cited by examiner

SEALED COMPRESSOR

BACKGROUND OF THE INVENTION

Field of the Invention

The present invention relates to a sealed compressor for use in a refrigeration cycle device such as a refrigerator, an air compressor, etc.

Description of the Related Art

In recent years, there has been an increasing demand for energy saving to conserve global environment. In particular, there has been a strong demand for higher efficiency in compressors for use in refrigerators, other refrigeration cycle devices, or the like, air compressors for use in fields of industries, etc.

As a conventional sealed compressor of this type, there is known a compressor in which a recess is formed on the upper surface of a piston reciprocatable inside a cylinder and its efficiency is improved (Japanese Examined Patent Application Publication. No. Hei. 8-6689)

FIG. 22 is a longitudinal sectional view of a conventional sealed compressor disclosed in Japanese Examined Patent Application Publication No. Hei. 8-6689. FIG. 23 is a plan view of a piston of the conventional sealed compressor when viewed from a tip end surface side. FIG. 24 is an enlarged cross-sectional view of major components of the upper portion of the piston and a valve plate portion in the conventional sealed compressor.

Referring to FIGS. 22, 23, and 24, in this sealed compressor, a sealed container 1 reserves oil 2 in a bottom portion thereof and is filled with a working fluid 4. The sealed compressor 1 accommodates a compressor body 6 elastically supported inside the sealed container 1 by a suspension spring 8.

The compressor body 6 includes an electric (electrically driven) element 10 and a compression element 12 rotationally driven by the electric element 10. The compression element 12 is positioned below the electric element 10. The electric element 11 includes a stator 14 and a rotor 16.

The compression element 12 includes a crankshaft 22 having a main shaft 20 and an eccentric shaft 18, a cylinder 26 defining a compression chamber 24, a cylinder block 30 provided integrally with a bearing 28 supporting the main shaft 20, a piston 32 which is slidable inside the cylinder 26, a valve plate 34 for closing the end surface of the cylinder 26, a suction valve 38 provided on the valve plate 34 to open and close a suction hole (not shown) and a discharge hole 36 which provide communication between inside and outside of the compression chamber 24, a discharge valve 40, and a coupling member 42 for coupling the eccentric shaft 18 to the piston 32.

A cylinder head 44 is positioned to cover the valve plate 34 on an opposite side of the compression chamber 24. The valve plate 34 and the cylinder head 44 form a head space 46.

The main shaft 20 of the crankshaft 22 is pivotally mounted on the bearing 28 of the cylinder block 30. The rotor 16 is fastened to the main shaft 20.

As shown in FIGS. 23 and 24, a recess 50 is formed on an upper surface (tip end surface) 48 of the piston 32. When viewed from a direction in which the piston 32 moves, at least a portion of the recess 50 overlaps with a portion of the discharge hole 36. A surface 52 of the upper surface 48 which is other than the recess 50 is flat, and is parallel to an inner surface of the valve plate 34.

The operation of the above configured conventional sealed compressor will now be described.

In the sealed compressor, a current is supplied to the stator 14 to generate a magnetic field, and thereby the rotor 16 secured to the main shaft 20 is rotated, which causes the crankshaft 22 to be rotated. The piston 32 reciprocatingly slides inside the cylinder 26 via the coupling member 42 attached to the eccentric shaft 18. Thus, a series of cycles which are a suction step, a compression step, and a discharge step are repeated.

In the suction step, when the piston 32 moves in a direction to increase the volume of the cylinder 26, the working fluid 4 in the compression chamber 24 is expanded. When the pressure in the compression chamber 24 becomes lower than a suction pressure, the suction valve 38 opens, due to a difference between a pressure in the compression chamber 24 and a pressure in a lower-pressure side (not shown) of a refrigeration cycle. The working fluid 4 which has returned from the refrigeration cycle and has a low temperature flows into the compression chamber 24 through the suction hole (not shown).

Then, in the compression step, when the piston 32 moves from a bottom dead center corresponding to a greatest volume of the compression chamber 24 in a direction to reduce the volume of the compression chamber 24, the pressure in the compression chamber 124 increases, and the suction valve 38 is closed, due to a difference between the pressure in the compression chamber 24 and the pressure in the lower-pressure side (not shown) of the refrigeration cycle, so that the compression chamber 24 is closed.

Thereafter, when the piston 32 moves in a direction to further reduce a volume of the compression chamber 24, the working fluid 4 is compressed up to a predetermined pressure.

In the discharge step, when the pressure of the working fluid 4 inside the compression chamber 24 increases and becomes higher than a pressure in the head space 46 defined by the valve plate 34 and the cylinder head 44, the discharge valve 40 opens due to a pressure difference, causing the working fluid 4 inside the compression chamber 24 to flow into the head space 46 through the discharge hole 36. Then, the working fluid 4 flows into a discharge muffler (not shown) from the head space 46 and is released to a higher-pressure side (not shown) of the refrigeration cycle.

When the piston 32 is in a top dead center in which the piston 32 is positioned closest to the valve plate 34 and the volume of the compression chamber 24 is smallest, there is a clearance between the piston 32 and the valve plate 34 to avoid interference between the piston 32 and the valve plate 34, and there is a small volume left in the compression chamber 24. The working fluid 4 remains in this small volume and is not discharged. Therefore, in the suction step, the remaining working fluid 4 and the working fluid 4 which has newly flowed into the compression chamber 24 through the suction hole (not shown) are mixed and compressed together.

The recess 50 formed on the upper surface 48 of the piston 32 increases a clearance of a space between the valve plate 34 and the recess 50 in a state where the piston 32 is in the top dead center, thereby ensuring a greater area of a fluid passage through which the working fluid 4 moves from the upper surface 48 of the piston 32 across the space between the valve plate 34 and the recess 50 and flows into the discharge hole 36.

As a result, the flow state of the working fluid 4 flowing into the discharge hole 36 can be improved. By reducing a distance of the clearance between the valve plate 34 and the upper surface 48 of the piston 32 and reducing the volume of this space in the state where the piston 32 is in the top dead center, a volume efficiency of the compressor can be improved.

There is also known a configuration in which a projection is provided on the tip end surface of a piston, and the projection moves into a discharge hole of a valve plate, thereby lessening the amount of a working fluid remaining in a compression chamber to a minimum level (see e.g., Japanese Laid-Open Patent Application Publication No. 2010-90705).

However, in the conventional configuration disclosed in Japanese Examined Patent Application Publication No. Hei. 8-6689, in the compression step in which the piston 32 moves in the direction to reduce the volume of the compression chamber 24, the working fluid 4 flows toward the center of the recess 50 in the vicinity of the upper surface 48 and the recess 50 in the piston 32. Therefore, flow components of the working fluid 4 cross each other in the center portion of the recess 50.

This results in a situation in which the flow of the working fluid 4 inside the compression chamber 24 is disordered when the working fluid 4 is compressed, which precludes the flow of the working fluid 4 into the discharge hole 36.

Therefore, in the above configuration, when the piston 32 is in the top dead center, the weight of the working fluid 4 remaining in the space between the piston 32 and the valve plate 34 increases, and the remaining working fluid 4 re-expands in the suction step, which results in a reduced volume efficiency.

In the configuration disclosed in Japanese Laid-Open Patent Application Publication No. 2010-90705, efficiency of the compressor can be possibly improved effectively, but the flow of the working fluid flowing toward the projection is disordered, which leaves a room for improvement.

SUMMARY OF THE INVENTION

The present invention is directed to solving the problems associated with the prior art, and an object of the present invention is to improve the flow state of a working fluid inside a compression chamber and reduce the weight of the working fluid remaining in the compression chamber in a state where a piston is in a top dead center, thereby lessening re-expansion of the working fluid in a suction step and increasing a volume efficiency so that the efficiency of a compressor can be improved.

According to the present invention, a sealed compressor comprises an electric element; a compression element driven by the electric element; and a scaled container accommodating the electric element and the compression element; wherein the compression element includes a cylinder block defining a compression chamber; a piston which is reciprocatable inside the compression chamber; and a valve plate disposed to close an opening end of the compression chamber and having a discharge hole which provides communication between inside and outside of the compression chamber; the piston has a first groove on a tip end surface thereof which faces the valve plate, the first groove having a predetermined width and extending from an outer peripheral edge portion of the tip end surface toward a portion of the tip end surface which faces the discharge hole; and a tip end portion of the first groove is positioned in the portion of the tip end surface which faces the discharge hole and is inclined.

In accordance with this configuration, during a compression step in which the piston moves from a bottom dead center to a top dead center, a working fluid present near the inner peripheral surface of the compression chamber (outer peripheral edge portion of the tip end surface of the piston) which is distant from the discharge hole can be guided to the portion of the tip end surface of the piston which faces the discharge hole by the first groove and can be guided efficiently to the discharge hole by the tip end portion of the first groove.

In the sealed compressor of the present invention, the tip end surface of the piston may have a circular shape; and the predetermined width of the first groove may be not less than 10% of a diameter of the piston and not greater than 30% of the diameter of the piston.

In the sealed compressor of the present invention, the piston may have a second groove on the tip end surface thereof which faces the valve plate, the second groove having a predetermined width and extending from the outer peripheral edge portion of the tip end surface toward the portion of the tip end surface which faces the discharge hole; and a base end portion of the second groove may be most distant from a base end portion of the first groove; a tip end portion of the second groove may be positioned in the portion of the tip end surface which faces the discharge hole and may be inclined.

In the sealed compressor of the present invention, the piston may be provided with a projection on the tip end surface thereof which faces the valve plate; and the projection may be inserted into the discharge hole of the valve plate in a state where the piston is in a top dead center.

This makes it possible to reduce a volume of a space in which the working fluid remains, including a volume of a discharge hole portion, in the state where the piston is in substantially the top dead center.

As a result, in the state where the piston is in substantially the top dead center, it is possible to reduce the weight of the working fluid remaining in a clearance volume between the piston and valve plate, and lessen a re-expansion amount of the remaining working fluid in a suction step, which improves a volume efficiency. Since it is possible to suppress excess compression which would otherwise be caused by the fact that the working fluid stays near the inner peripheral surface of the compression chamber, it is possible to provide a sealed compressor which can reduce the amount of electric power fed to the compressor and improve efficiency.

In the sealed compressor of the present invention, the first groove and the second groove may communicate with each other; at least one of the first groove and the second groove may be provided with a projection on a bottom surface thereof; and the projection may be inserted into the discharge hole of the valve plate in a state where the piston is in a top dead center.

This makes it possible to reduce a volume of a space in which the working fluid remains, including a volume of a discharge hole portion, in the state where the piston is in substantially the top dead center.

As a result, in the state where the piston is in substantially the top dead center, it is possible to reduce the weight of the working fluid remaining in a clearance volume between the piston and valve plate, and lessen a re-expansion amount of the remaining working fluid in a suction step, which improves a volume efficiency. Since it is possible to suppress excess compression which would otherwise be caused by the fact that the working fluid stays near the inner peripheral surface of the compression chamber, it is possible to provide a sealed compressor which can reduce the amount of electric power fed to the compressor and improve efficiency.

In accordance with this configuration, the working fluid can be guided from the sides sandwiching the projection to the discharge hole. As a result, it is possible to further reduce the working fluid remaining in the clearance volume between the piston and the valve plate and to further suppress excess compression which would otherwise be caused by the fact that the working fluid stays near the inner peripheral surface of the compression chamber. Therefore, it is possible to provide a sealed compressor which can further reduce the amount of electric power fed to the compressor and further improve efficiency.

In the sealed compressor of the present invention, the projection may have a flat surface facing a flow of a working fluid.

In accordance with this configuration, the working fluid flowing toward the discharge hole along the first groove can be guided efficiently to the discharge hole. This makes it possible to further reduce the amount of working fluid remaining in the compression chamber in the discharge step and further improve efficiency of the sealed compressor.

In the sealed compressor of the present invention, the projection may have a pair of side walls which are parallel to a direction in which the first groove extends.

In accordance with this configuration, it is possible to suppress a disordered flow of the working fluid flowing along the first groove and guide the working fluid to the discharge hole smoothly.

In the sealed compressor of the present invention, the projection may have a shape in which an angle formed between a flat surface protruding from the tip end surface of the piston and the tip end surface of the piston is not less than 90 degrees and not greater than 110 degrees.

In the sealed compressor of the present invention, the projection may have a center axis conforming to a center axis of the discharge hole.

In accordance with this configuration, if the projection is laterally symmetric when viewed from the center axis direction of the discharge hole and the first groove forming a flow passage of the working fluid is laterally symmetric with respect to the projection, it is possible to provide a sealed compressor which can make the flow of the working fluid smoother and further improve efficiency.

As used herein, the phrase "the first groove is laterally symmetric with respect to the projection" is meant to include a structure in which the first groove is imperfectly laterally symmetric with respect to the projection. That is, the first groove need not be laterally symmetric with respect to the projection so long as the advantage of the present invention is achieved. For example, the first groove may have a shape in which the width of the bottom surface of the first groove at the left side of the projection, or the depth of the bottom surface of the first groove at the left side of the projection is smaller or greater than the width of the bottom surface the first groove at the right side of the projection, or the depth of the bottom surface of the first groove at the right side of the projection, respectively, when viewed from the direction in the working fluid flows (direction from the base end portion of the first groove toward the tip end portion of the first groove), so long as the advantage of the present invention can be achieved.

In the sealed compressor of the present invention, the first groove may extend along a diameter of the piston which passes through the portion of the tip end surface of the piston which faces the discharge hole; and a base end portion of the first groove may be positioned on a portion of the outer peripheral edge portion which is distant from the portion of the tip end surface which faces the discharge hole.

In the sealed compressor of the present invention, the first groove may have a shape in which an angle formed between an inclined surface forming the tip end portion of the first groove and the tip end surface of the piston is not less than 90 degrees and not greater than 110 degrees.

In the sealed compressor of the present invention, the projection may protrude from the tip end surface of the piston along the inclined surface forming the tip end portion of the first groove.

In the sealed compressor of the present invention, the predetermined width of the first groove may be not less than 2 mm and not greater than 6 mm, and a portion of the first groove which is other than the tip end portion may have a depth which is not less than 20 μm and not greater than 60 μm.

In the sealed compressor of the present invention, the first groove may have a shape in which a bottom surface thereof is inclined to have a depth decreasing from a base end portion thereof toward the tip end portion.

In the sealed compressor of the present invention, the first groove may have a shape in which the base end portion has a depth which is not less than 10 μm and not greater than 500 μm.

In accordance with this configuration, it is possible to provide a sealed compressor which can improve its efficiency by optimizing the depth of the first groove.

The above and further objects and features of the invention will more fully be apparent from the following detailed description with accompanying drawings.

DETAILED DESCRIPTION OF THE PREFERRED EMBODIMENTS

Figure 1:
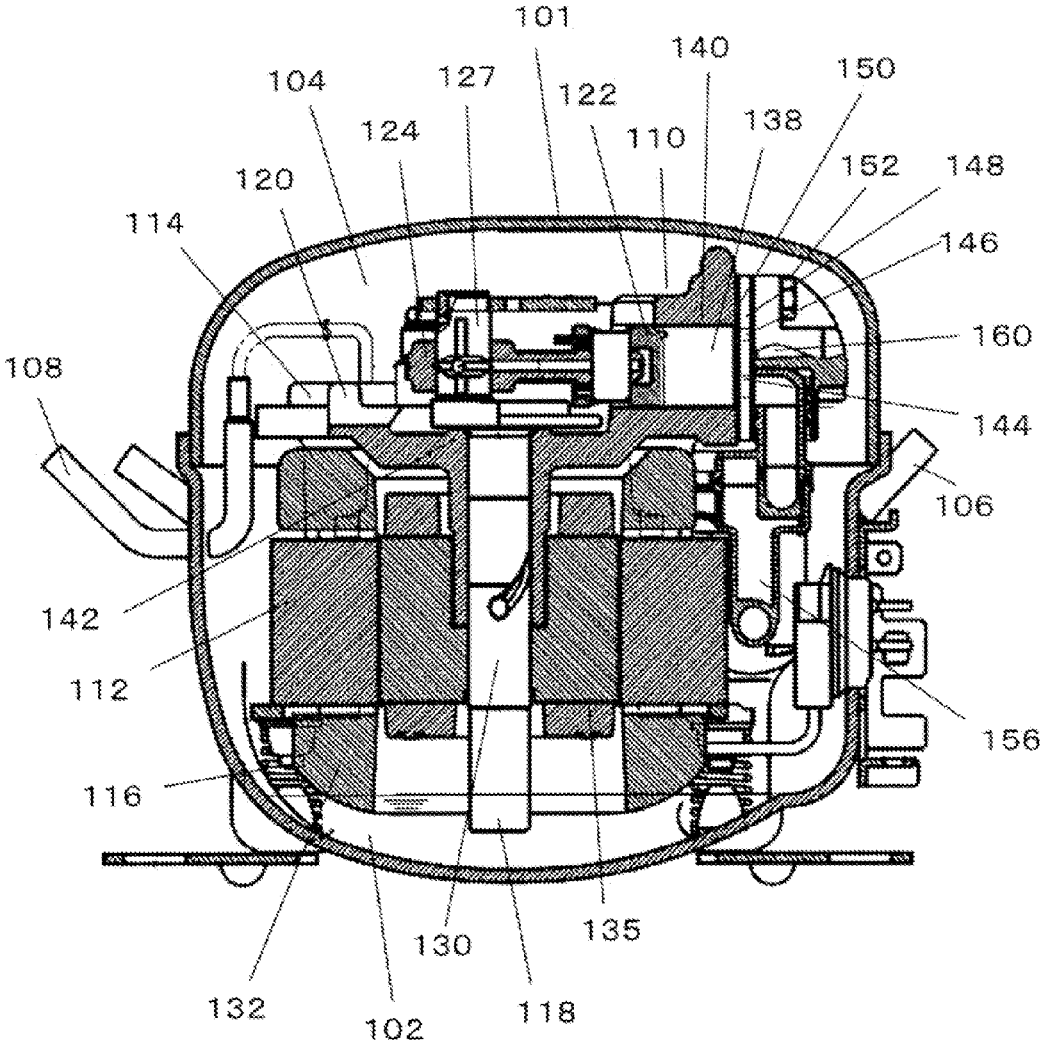
FIG. 1 is longitudinal sectional view of a sealed compressor according to Embodiment 1 of the present invention.

Hereinafter, preferred embodiments of the present invention will be described with reference to the drawings. Throughout the drawings, the same or corresponding parts are designated by the same reference numerals and repetitive description thereof is sometimes omitted. Throughout the drawings, components required to explain the present invention are extracted and depicted, and other components are omitted. Furthermore, the present invention is in no way limited to the following embodiments in some cases.

Figure 2:
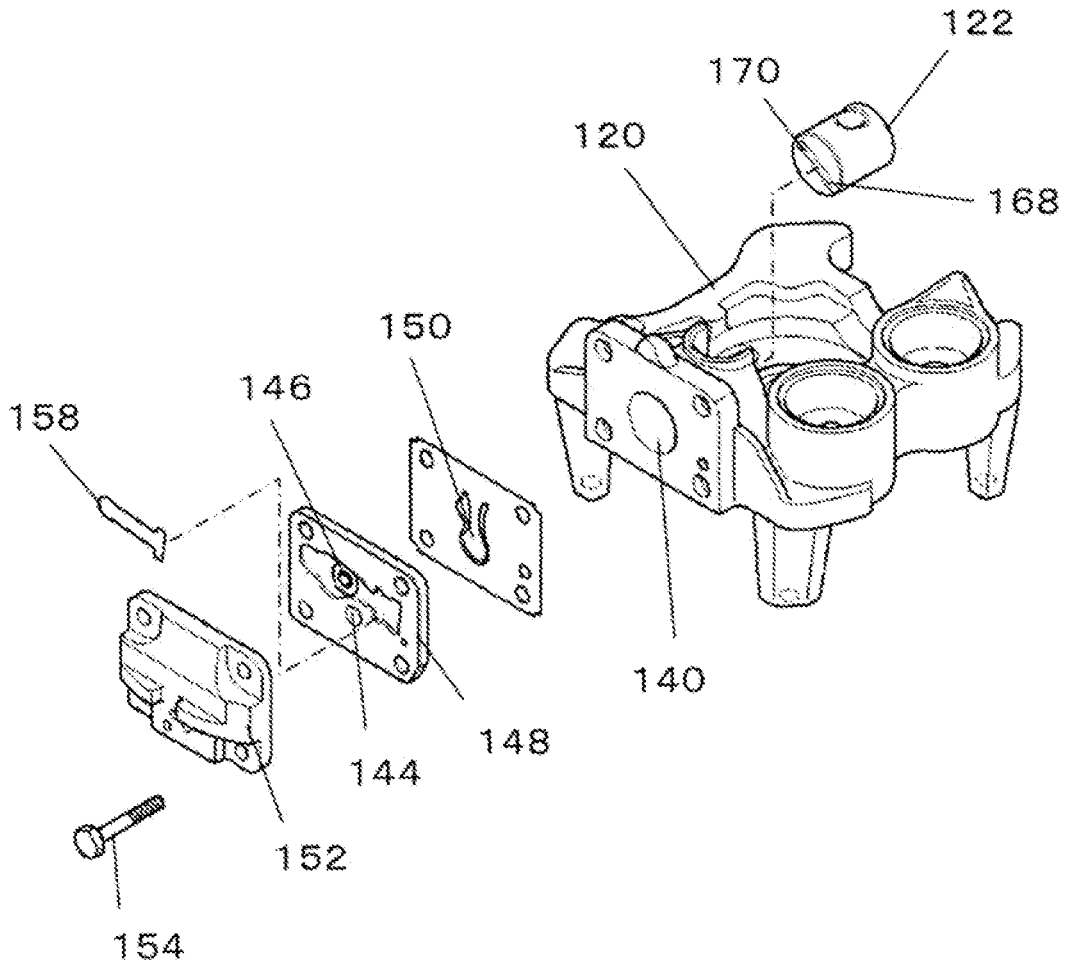
FIG. 2 is an exploded perspective view of a compression element in the sealed compressor of Embodiment 1.
Figure 3:
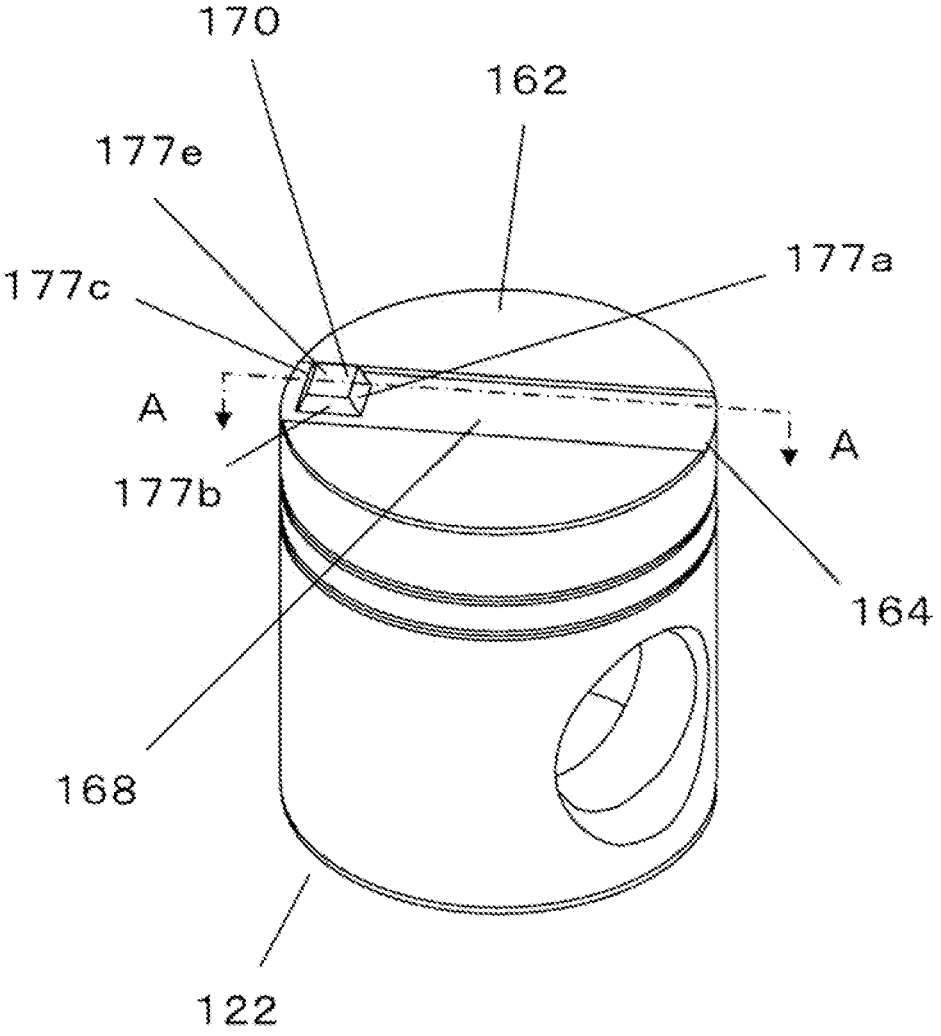
FIG. 3 is a perspective view of a piston constituting the compression element in the sealed compressor of Embodiment 1.
Figure 4:
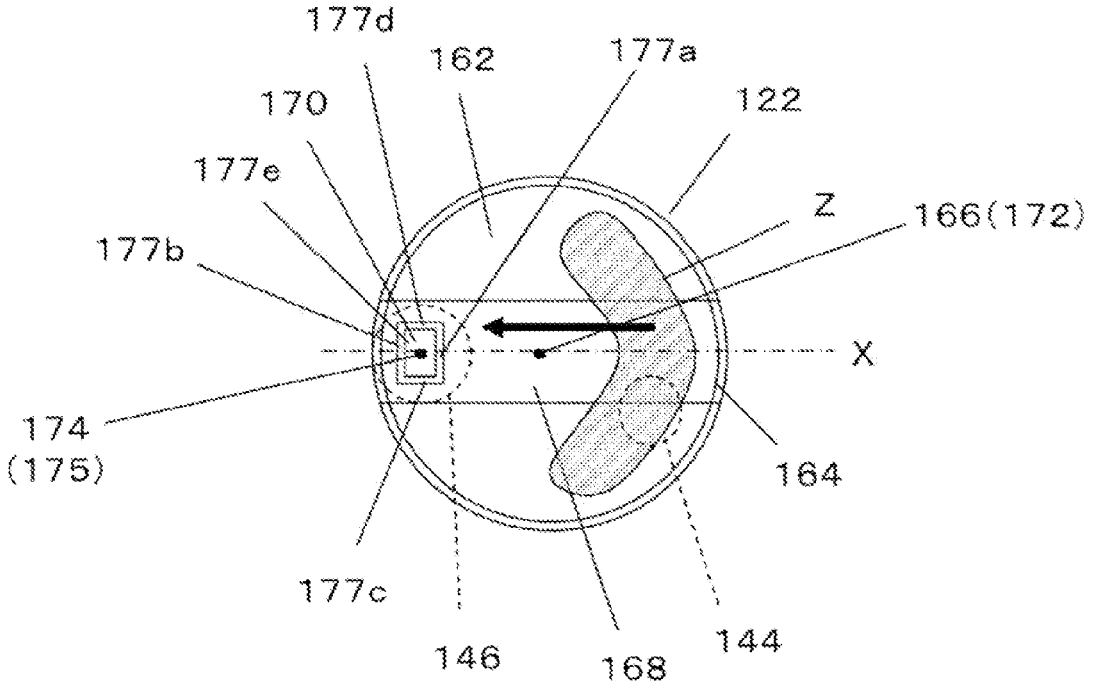
FIG. 4 is a plan view of the piston in the sealed compressor of Embodiment 1.
Figure 5:
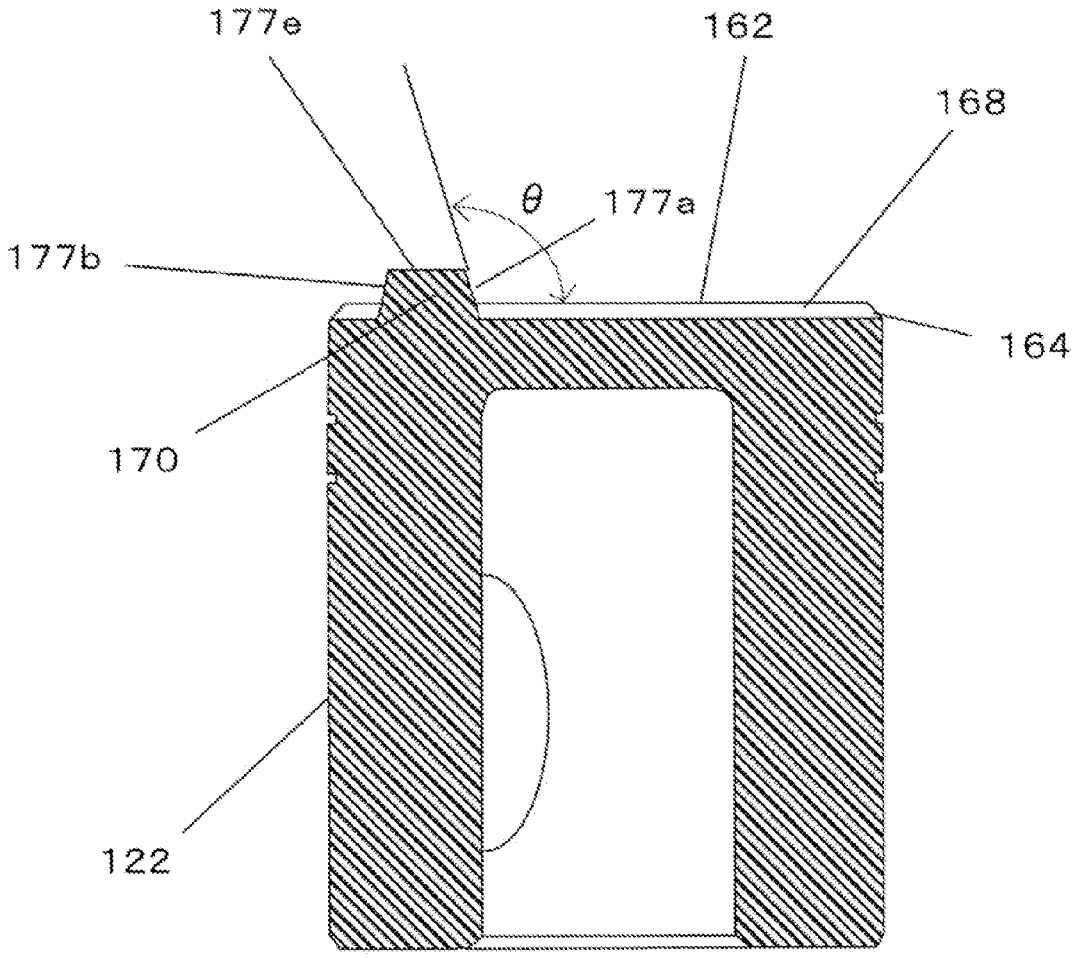
FIG. 5 is a longitudinal sectional view of the piston in the sealed compressor of Embodiment 1, taken along line A-A of FIG. 3.
Figure 6:
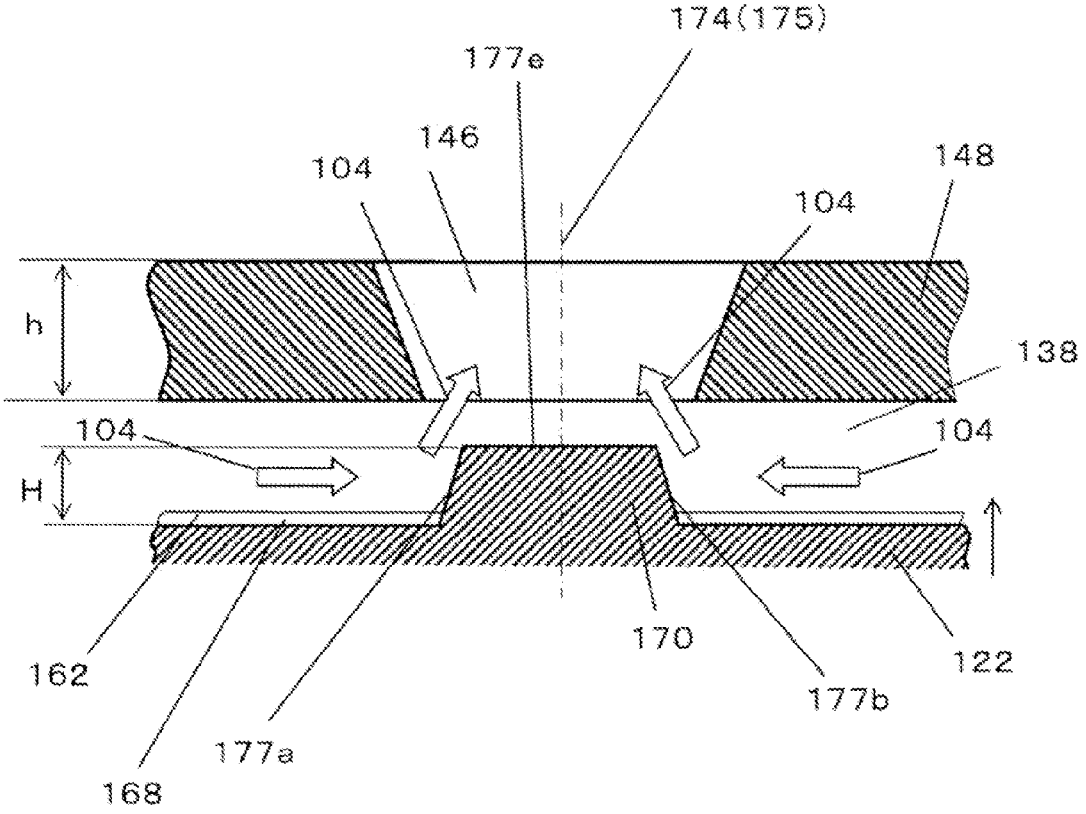
FIG. 6 is an enlarged cross-sectional view of major components in the sealed compressor of Embodiment 1.

FIG. 1 is longitudinal sectional view of a sealed compressor according to Embodiment 1 of the present invention. FIG. 2 is an exploded perspective view of a compression element in the sealed compressor of Embodiment 1. FIG. 3 is a perspective view of a piston constituting the compression element in the scaled compressor of Embodiment 1. FIG. 4 is a plan view of the piston in the sealed compressor of Embodiment 1. FIG. 5 is a longitudinal sectional view of the piston in the sealed compressor of Embodiment 1, taken along line A-A of FIG. 3. FIG. 6 is an enlarged cross-sectional view of major components in the sealed compressor of Embodiment 1.

Referring to FIGS. 1 to 6, the sealed compressor according to Embodiment 1 includes a sealed container 101 which reserves oil 102 and is filled with a cooling medium as a working fluid 104. As an example of the cooling medium, there is hydrocarbon based R600a having a low global warming potential, etc.

The sealed container 101 is manufactured by drawing of a steel plate. The sealed container 101 is provided with a suction pipe 106 and a discharge pipe 108. The suction pipe 106 penetrates the sealed compressor 101. The upstream end of the suction pipe 106 is coupled to a lower-pressure side (not shown) of a refrigeration cycle, while the downstream end thereof communicates with the interior of the sealed container 101. The discharge pipe 108 penetrates the sealed compressor 101. The upstream end of the discharge pipe 108 communicates with a discharge muffler (not shown), while the downstream end thereof is coupled to a higher-pressure side (not shown) of the refrigeration cycle.

The sealed container 101 accommodates a compressor body 114 including a compression element 110 and an electric (electrically driven) element 112 for driving the compression element 110. The compressor body 114 is elastically supported on the sealed container 101 by a suspension spring 116.

The compression element 110 includes a crankshaft 118, a cylinder block 120, a piston 122, a coupling member 124, etc. The crankshaft 118 includes a main shaft 130 and an eccentric shaft 127. The piston 122 has a cylindrical shape and is manufactured by molding using a die.

The electric element 112 includes a stator 132 fastened to the lower side of the cylinder block 120 by means of a bolt (not shown), and a rotor 135 disposed inward relative to the stator 132 and secured to the main shaft 130 by shrink fitting.

The cylinder block 120 is provided integrally with a cylinder 140 forming a compression chamber 138, and a bearing 142 for supporting the main shaft 130 such that the main shaft 130 is rotatable.

As shown in FIG. 2, a suction valve 150, a valve plate 148, and a cylinder head 152 are arranged in this order on the end surface of the cylinder 140 and sealably fastened to the end surface of the cylinder 140 by means of a head bolt 154. The valve plate 148 has a suction hole 144 and a discharge hole 146 which provide communication between inside and outside of the compression chamber 138. The suction valve 150 is configured to open and close the suction hole 144. The cylinder head 152 is configured to cover the valve plate 148.

A discharge valve 158 for opening and closing a discharge hole 146 is secured to the surface of the valve plate 148 which faces the cylinder head 152. The valve plate 148 and the cylinder head 152 form a head space 160. As shown in FIG. 1, a suction muffler 156 is retained between and secured to the valve plate 148 and the cylinder head 152.

A first groove 168 of a band shape (linear shape) is provided on a tip end surface 162 of the piston 122 which faces the valve plate 148. As shown in FIGS. 3 and 4, the first groove 168 extends in a diameter direction of the piston 122 from an outer peripheral edge portion 164 of the piston 122 which is most distant from the discharge hole 146 toward a portion of the tip end surface 162 which faces the discharge hole 146. A center axis X of the first groove 168 passes through a center axis 166 of the piston 122. The tip end portion of the first groove 168 is located on an outer peripheral edge of the tip end surface 162 which is most distant from the outer peripheral edge portion 164 and conforms to a base end portion of a second groove. The shape of the first groove 168 has a width set to 2 mm to 6 mm, and a depth set to 20 μm to 60 μm, based on an experiment result described later. In Embodiment 1, the first groove 168 and the second groove communicate with each other and therefore, they will not be distinguished from each other.

The first groove 168 is defined by a bottom surface and a pair of side walls and has a substantially constant depth. The first groove 168 is provided with a projection 170 on a portion of a bottom surface thereof which overlaps with the discharge hole 146 when viewed from the direction in which the piston 122 moves. The projection 170 is inserted into the discharge hole 146 of the valve plate 148 in a state where the piston 122 is in a top dead center. In other words, the projection 170 is inward relative to the discharge hole 146 when viewed from the direction in which the piston 122 moves. The projection 170 is provided integrally with the piston 122.

As shown in FIG. 6, the discharge hole 146 provided on the valve plate 148 is sized to allow the projection 170 of the piston 122 to be easily inserted thereinto. The discharge hole 146 is formed around a discharge hole center axis 174 which is eccentric from a compression chamber center axis 172 toward an outer periphery.

Thus, the projection center axis 175 is positioned so that the projection 170 is inserted through the discharge hole 146 to the head space 160, during the reciprocating movement of the piston 122, and substantially conforms to the discharge hole center axis 174. The projection center axis 175 is eccentric from the compression chamber center axis 172 and a piston center axis 166 substantially conforming to the compression chamber center axis 172, toward the outer periphery.

Referring to FIGS. 3 and 4, the projection 170 has a shape in which a cross-section of a surface parallel to the tip end surface 162 of the piston 122 has a rectangular shape, i.e., fundamentally has a rectangular parallelepiped shape (including a truncated square pyramid shape) and has four flat surfaces (hereinafter referred to as side walls) 177*a*, 177*b*, 177*c*, 177*d*, and a top surface 177*e*. In the projection 170, the side walls 177*a* and 177*b* having a greater area cross the side walls 177*c* and 177*d* having a smaller area at about 90 degrees (including 90 degrees). Therefore, the projection 170 has a shape in which the top surface 177*e* perpendicular to the piston center axis 166 has a substantially rectangular shape (including a rectangular shape).

To allow the working fluid to flow into the discharge hole 146, a ratio (top surface 177*e*/bottom surface of the projection 170) of the area of the top surface 177*e* of the projection 170 with respect to the area of the surface (hereinafter referred to as the bottom surface of the projection 170) of the projection 170 which is connected to the tip end surface 162 of the piston 122 is preferably not less than 0.2 and more preferably not less than 0.5. Also, to avoid that the flow of the working fluid into the discharge hole 146 is precluded, the ratio of the area of the top surface 177*e* of the projection 170 with respect to the area of the bottom surface of the projection 170 is preferably not greater than 1, and more preferably not greater than 0.75.

A ratio of the area of the bottom surface of the projection 170 with respect to the area of the opening of the discharge hole 146 (bottom surface of the projection 170/opening of the discharge hole 146) is preferably not less than 0.3 to allow the working fluid to flow into the discharge hole 146, and preferably not greater than 0.6, to avoid that the flow of the working fluid into the discharge hole 146 is precluded.

As shown in FIG. 5, an angle θ formed between the four side walls 177*a*, 177*b*, 177*c*, and 177*d* of the projection 170 and the tip end surface 162 of the piston 162 is set to about 110 degrees (including 110 degrees). The angle θ includes a draft angle (angle) of a die used for molding the piston 122 and the projection 170. The draft angle may be set to a desired angle. In view of this and based on an experimental result as described later, the angle θ is set to not less than 90 degrees and not more than 110 degrees.

As shown in FIG. 4, among the four side walls 177*a*, 177*b*, 177*c*, and 177*d* of the projection 170, the side wall 177*a* having a greater area faces the piston center axis (center) 166 side, while the pair of side walls 177*c*, 177*d* having a smaller area are substantially parallel to the side walls defining the first groove 168.

As shown in FIG. 6, the projection 170 has a height H set slightly smaller than a thickness h of the valve plate 148. To be more specific, the height H of the projection 170 and the thickness h of the valve plate 148 are set so that the top surface 177*e* of the projection 170 is in a height position of 65~75% of the thickness h of the valve plate 148 from the inner surface of the valve plate 148, in the state where the piston 122 is in the top dead center.

Subsequently, the operation and advantages of the sealed compressor configured as described above will be described.

In the sealed compressor, a current is supplied to the stator 132 to generate a magnetic field, and the rotor 135 fastened to the main shaft 130 is rotated, thereby causing the crankshaft 118 to be rotated. The piston 122 reciprocatingly slides inside the cylinder 140 via the coupling member 124 rotatably attached to the eccentric shaft 127.

According to the reciprocation movement of the piston 122, the working fluid 104 is suctioned into the compression chamber 138 via the suction muffler 156 and compressed therein. After that, the working fluid 104 is discharged through the discharge hole 146 and flows to the refrigeration cycle (not shown) through the head space 160.

Figure 7:
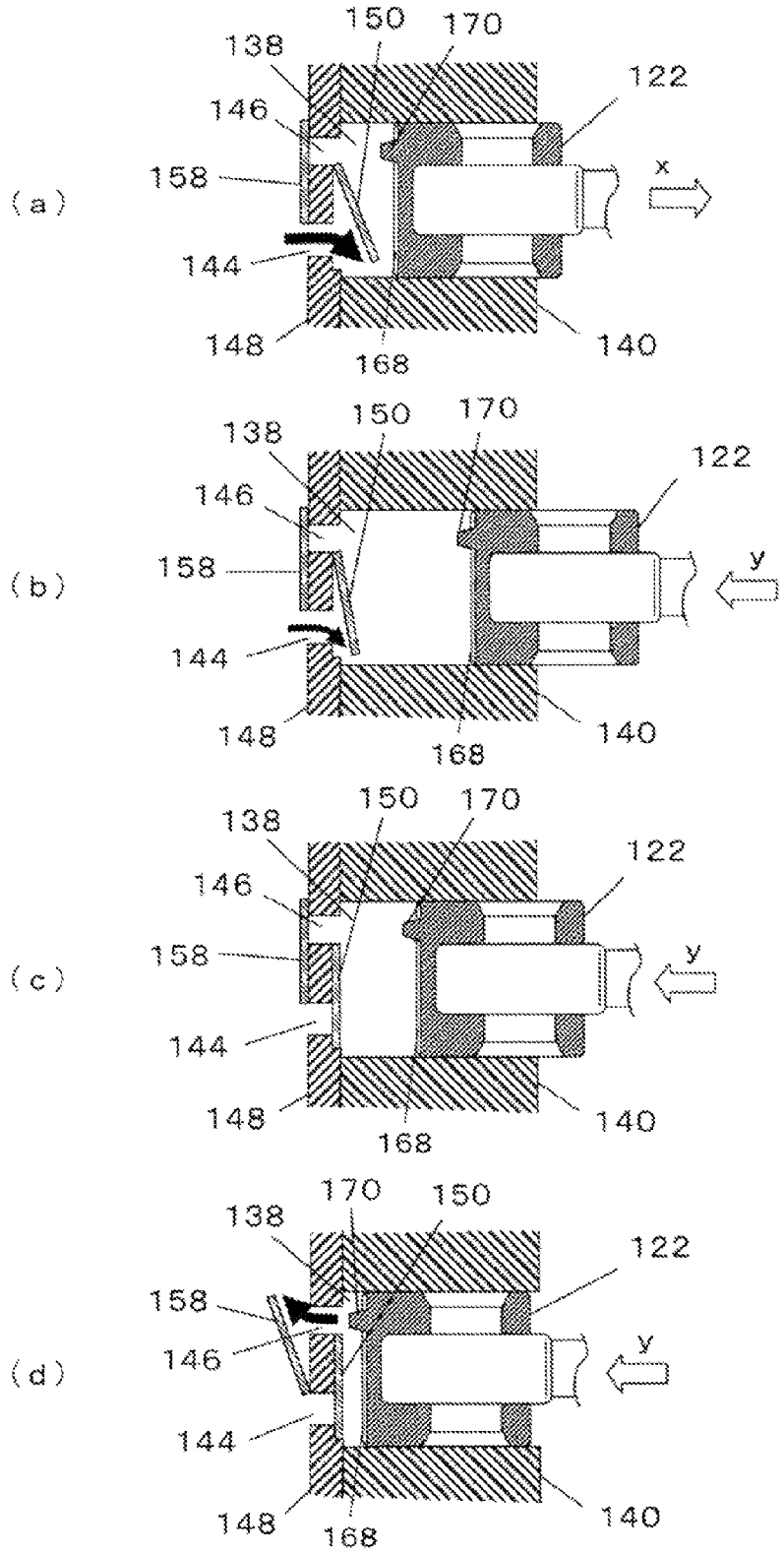
FIG. 7 is a schematic view showing the operation of the sealed compressor of Embodiment 1.

Next, a description will be given of the suction step, the compression step, and the discharge step of the working fluid 104 which is performed by the compressor body 114, with reference to FIG. 7. FIG. 7 is a schematic view showing the operation of the sealed compressor of Embodiment 1. FIG. 7A shows the operation in the middle of the suction step. FIG. 7B shows the end of the suction step (the piston 122 is near bottom dead center). FIG. 7C shows the operation in the middle of the compression step. FIG. 7D shows the discharge step (the piston 122 is near top dead center).

As shown in FIG. 7A, in the suction step, when the piston 122 moves in an arrow x direction to increase the volume of the compression chamber 138, the working fluid 104 in the interior of the compression chamber 138 expands, and thereby the pressure in the compression chamber 138 decreases. When the pressure in the compression chamber 138 becomes lower than the pressure in the suction muffler 156, the suction valve 150 opens due to a difference between the pressure in the compression chamber 138 and the pressure in the suction muffler 156. Thereupon, the working fluid 104 which has returned from the refrigeration cycle is released into the sealed container 101 through the suction pipe 106. After that, the working fluid 104 flows into the compression chamber 138 through the suction muffler 156.

Subsequently, as shown in FIG. 7B, in the compression step, when the piston 122 moves from the bottom dead center in an arrow y direction to decrease the volume of the compression chamber 138, the pressure in the compression chamber 138 increases, and the suction valve 150 is closed due to a difference between the pressure in the compression chamber 138 and the pressure in the suction muffler 156, so that the compression chamber 138 is closed. As shown in FIG. 7C, when the piston 122 further moves in the arrow y direction in a direction to decrease the volume of the compression chamber 138, the working fluid 104 is compressed up to a predetermined pressure.

As shown in FIG. 7D, in the discharge step, when the pressure in the working fluid 104 in the interior of the compression chamber 138 increases and becomes higher than the pressure in the head space 160 defined by the valve plate 148 and the cylinder head 152, the discharge valve 158 opens due to a pressure difference. As a result, the working fluid 104 flows from the compression chamber 138 into the head space 160 through the discharge hole 146.

Then, the working fluid 104 flows from the head space 160 to the discharge muffler (not shown), and further to the higher-pressure side (not shown) of the refrigeration cycle through the discharge pipe 108.

When the pressure in the compression chamber 138 becomes lower than the pressure in the head space 160, the discharge valve 158 is closed, and thereby the compression chamber 138 is closed. The piston 122 moves to the bottom dead center again and shifts to the suction step again.

In the state where the piston 122 is in the top dead center, there is a clearance formed between the piston 122 and the valve plate 148 to avoid interference between them, and a small volume is left in the compression chamber 138.

The working fluid 104 remains in a portion of the compression chamber 138 corresponding to this small volume. The remaining working fluid 104 is not discharged. In the suction step, the remaining working fluid 104 and the working fluid 104 which has flowed from the suction muffler 156 through the suction hole 144 are mixed and compressed.

In the conventional configuration, because of re-expansion of the working fluid 104 remaining near the inner peripheral surface of the compression chamber 138 as described above, improvement of a compression efficiency is limited.

As a solution to this, in the compressor of Embodiment 1, the first groove 168 is provided on the tip end surface 162 of the piston 122 such that the first groove 168 extends within a range of the diameter of the piston 122 from a portion of the outer peripheral edge portion 164 of the piston 122 which is most distant from the discharge hole 146, toward a portion of the tip end surface 162 which faces the discharge hole 146. This makes it possible to discharge the working fluid 104 present near the inner peripheral surface of the compression chamber 138 and compressed can be discharged through the discharge hole 146 to a greatest possible amount. In this way, advantages which cannot be achieved by the conventional configuration can be attained.

In addition, in the compressor of Embodiment 1, the projection 170 is positioned to correspond to the discharge hole 146 to lessen the clearance between the piston 122 and the valve plate 148. This can lessen the working fluid 104 remaining in the compression chamber 138.

Figure 8:
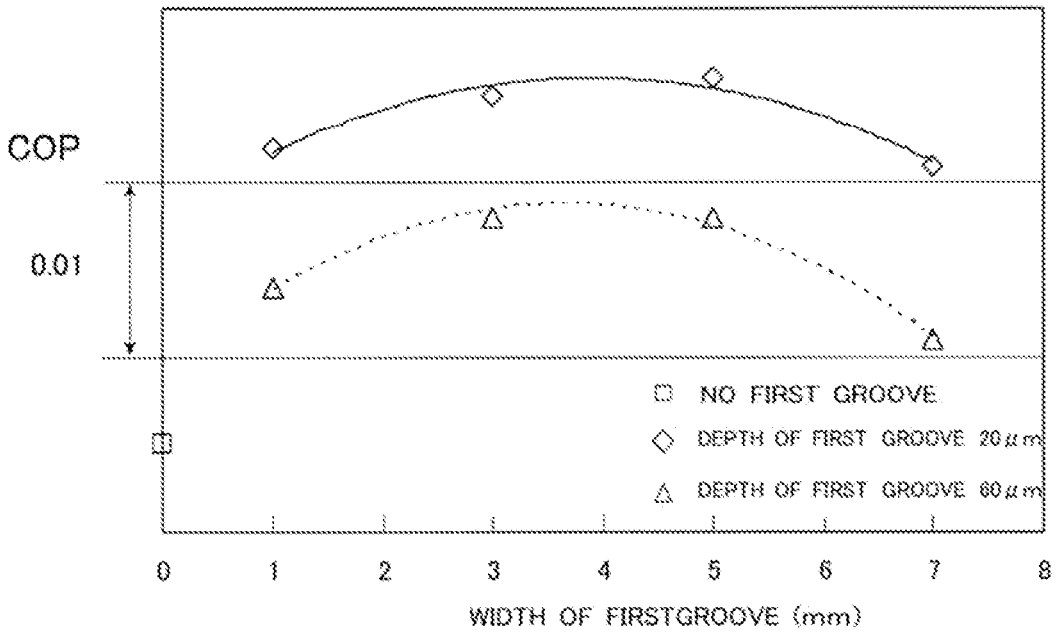
FIG. 8 is a view showing the relationship between the width and depth of a first groove and coefficient of performance COP in the sealed compressor of Embodiment 1.

The inventors discovered from an experiment that the shape of the first groove 168 affects the compression efficiency. To be specific, the inventors measured coefficients of performance (COP) for pistons 122 which are different in groove width and groove depth, and discovered that the shape of the first groove 168 affects the compression efficiency. Hereinafter, the relationship between the shape of the first groove 168 and the compression efficiency will be described with reference to FIG. 8. FIG. 8 is a view showing the relationship between the width and depth of the first groove 168 and the coefficient of performance (COP) in the sealed compressor of Embodiment 1.

As can be seen from FIG. 8, the first groove 168 having a width of 2 mm to 6 mm and a depth of 20 μm to 60 μm can improve the coefficient of performance COP of the compressor, and allows the working fluid 104 to be guided to the projection 170 efficiently, as compared to the configuration in which the first groove 168 is not provided.

Figure 9:
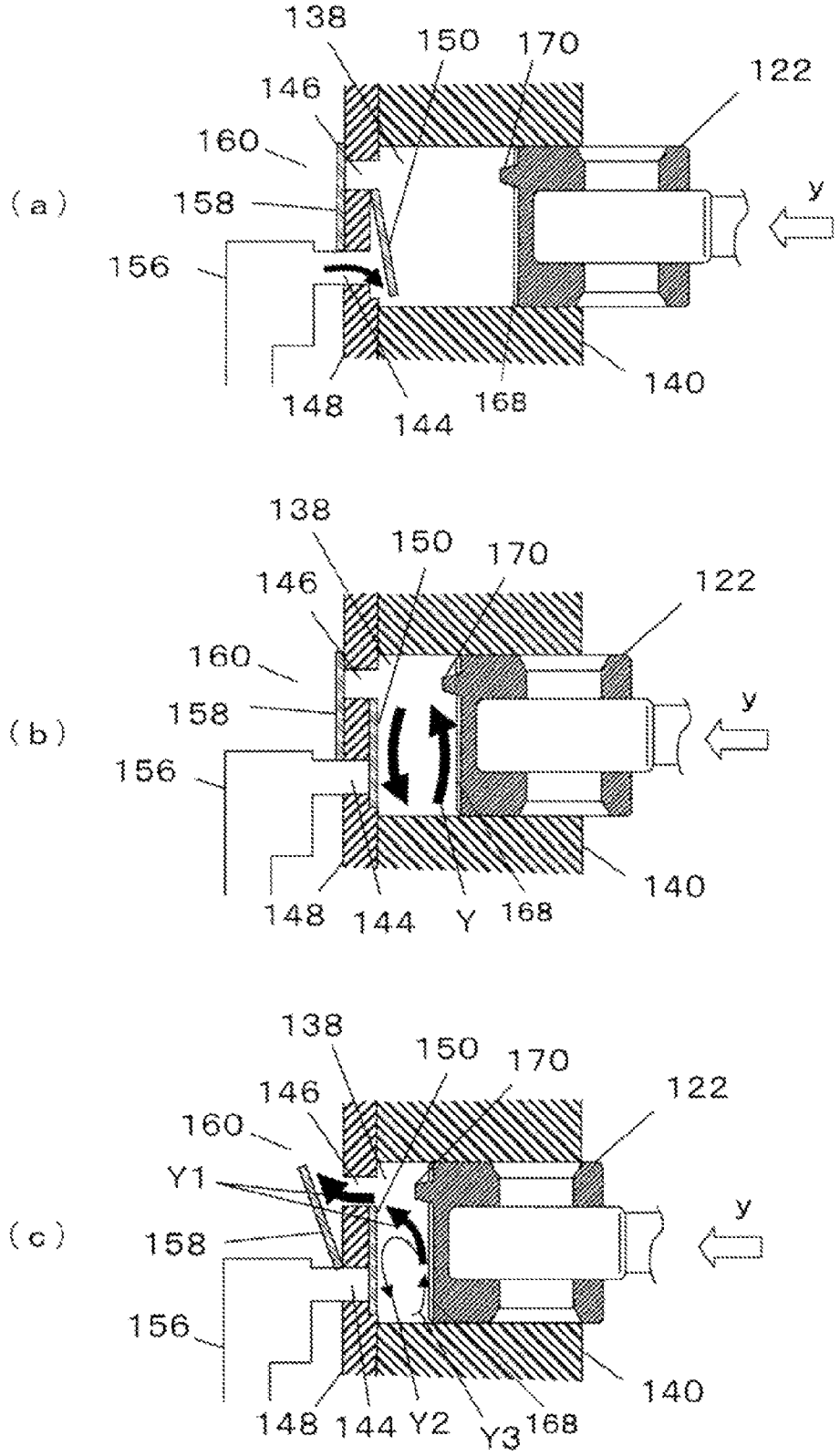
FIG. 9 is a schematic view showing the flow of a working fluid in a compression step in the sealed compressor of Embodiment 1.

Hereinafter, a description will be given of the flow of the working fluid 104 in the interior of the compression chamber 138 in the compression step and in the discharge step, with reference to FIG. 9. FIG. 9 is a schematic view showing the flow of the working fluid 104 in the compression step in the sealed compressor of Embodiment 1. FIG. 9A shows the operation immediately before compression starts (immediately before the end of suction, near the bottom dead center). FIG. 9B shows the operation in the middle of the compression. FIG. 9C shows the discharge step.

As shown in FIG. 9A, when the piston 122 moves in an arrow y direction from the state immediately before the compression starts, the pressure in the compression chamber 138 becomes higher than the pressure in the suction muffler 156, and the suction valve 150 is closed, the compression chamber 138 is closed as shown in FIG. 9B. When the piston 122 further moves toward the top dead center as indicated by an arrow y direction, i.e., in the direction to decrease the volume in the compression chamber 138, the working fluid 104 is compressed.

At this time, in the interior of the compression chamber 138, the working fluid 104 flows from the inner peripheral surface of the compression chamber 138 toward the discharge hole 146 along the bottom surface of the first groove 168 as indicated by an arrow Y because of the first groove 168 formed on the tip end surface 162 of the piston 122, in the vicinity of the tip end surface 162 of the piston 122.

As shown in FIG. 9C, when the pressure in the compression chamber 138 becomes higher than the pressure in the head space 160 and the discharge valve 158 opens, the working fluid 104 in the vicinity of the discharge hole 146 flows quickly to the discharge hole 146, and is discharged into the head space 160 through the discharge hole 146, as indicated by an arrow Y1.

The working fluid 104 in a space indicated by Z in FIG. 4 (near the inner peripheral surface of the compression chamber 138) which is distant from the discharge hole 146 is affected by the flow indicated by the arrow Y1, etc., and thereby a part of the working fluid 104 flows toward the inner peripheral surface of the compression chamber 138 as indicated by an arrow Y2 in FIG. 9C. It is presumed that in the conventional compressor, discharging of this working fluid 104 through the discharge hole 146 is retarded.

However, in the compressor of Embodiment 1, it is presumed that a specified flow of the working fluid 104 present near the inner peripheral surface of the compression chamber 138 is formed by the first groove 168 as indicated by an arrow Y3, and the working fluid 104 is guided toward the projection 170.

When the piston 122 reaches a location near the top dead center, the clearance between the tip end surface 162 and the valve plate 148 becomes smaller and a flow passage leading to the discharge hole 146 is narrowed. It is presumed that even in this state, the working fluid 104 remaining in the space Z is induced by the flow (arrow Y3) of the working fluid 104 flowing in the first groove 168 provided on the tip end surface 162 of the piston 122 and discharged through the discharge hole 146 smoothly.

Since the weight of the remaining working fluid 104 is reduced and re-expansion amount of the working fluid 104 is lessened, the volume efficiency can be improved.

Furthermore, the working fluid 104 in the space Z of the piston 122 is discharged smoothly to the head space 160 through the discharge hole 146, by the flow of the working fluid 104 generated in the first groove 168 provided on the tip end surface 162 of the piston 122 as described above without staying in the space Z. Therefore, it is possible to mitigate a local pressure increase mainly on the outer peripheral edge portion 164 of the tip end surface 162 of the piston 122 which would otherwise be caused by the working fluid 104 staying in the space Z and to lessen excess compression which will cause an unnecessary pressure increase. As a result, the amount of electric power supplied to the compressor can be reduced, and efficiency of the compressor can be improved.

As described above, the working fluid 104 present near the inner peripheral surface of the compression chamber 138 is induced by the flow of the working fluid 104 flowing in the first groove 168 provided on the tip end surface 162 of the piston 122 and discharged through the discharge hole 146. Therefore, the clearance between the piston 122 and the valve plate 148 can be made narrower, and the volume of the compression chamber 138 in the state where the piston 122 is in the top dead center can be set smaller. This can further reduce an allowable weight of the remaining working fluid 104, further lessen re-expansion (amount) of the working fluid 104, and further improve the volume efficiency.

The inventors discovered from an experiment that the angle θ formed between the tip end surface 162 of the piston 122 and at least the side wall 177*a* of the projection 170 affects the compression efficiency.

Figure 10:
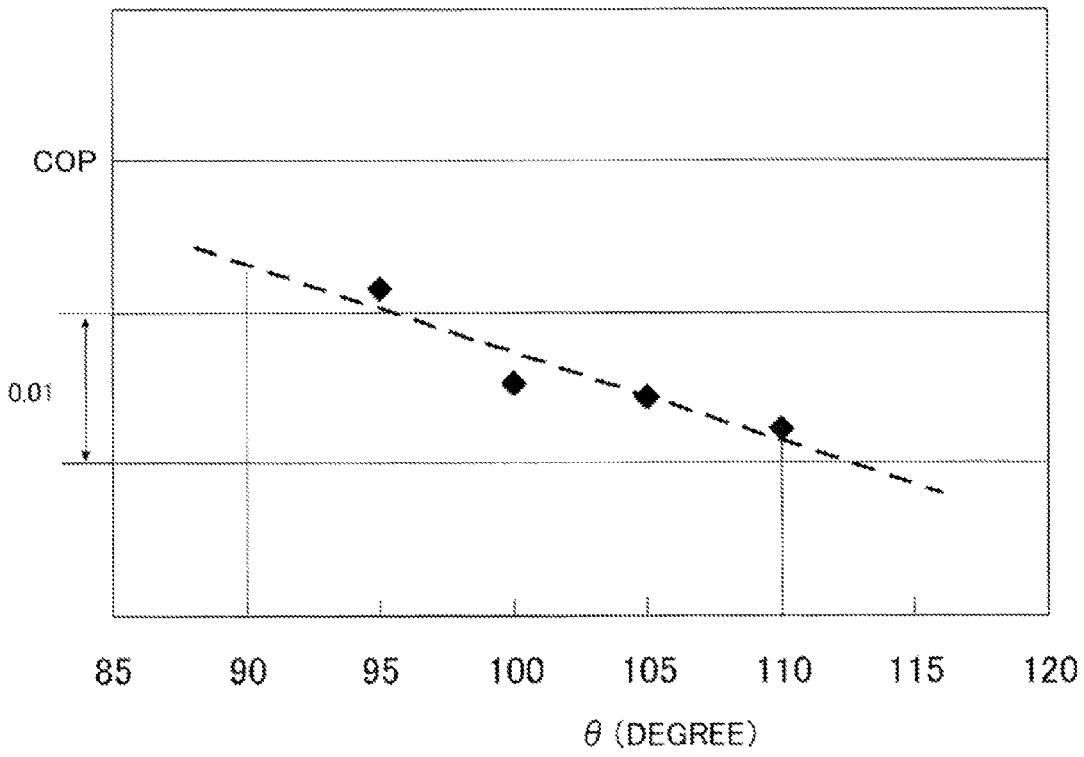
FIG. 10 is a view showing the relationship between a projecting angle θ of a projection (side wall) provided on the piston, and the coefficient of performance COP, in the sealed compressor of Embodiment 1.

Hereinafter, the advantages associated with the shape of the projection 170 of the piston 122 will be described with reference to FIG. 10. FIG. 10 is a view showing the relationship between a projecting angle θ of the projection (side wall) provided on the piston 122, and the coefficient of performance COP, in the sealed compressor of Embodiment 1. In FIG. 10, a horizontal axis indicates the angle θ (see FIG. 5) formed between the side wall 177*a* of the projection 170 of the piston 122 which is closest to the suction hole 144 and the tip end surface 162 of the piston 122, while a vertical axis indicates the coefficient of performance COP.

It was confirmed from the experiment that high efficiency of the compressor can be achieved when the cross-section of the projection 170 of the piston 122 which is substantially parallel to the tip end surface 162 of the piston 122 has a substantially rectangular shape and the angle θ formed between the side wall 177*a* of the projection 170 which is closest to the suction hole 144 and the tip end surface 162 of the piston 122, is 90 degrees≤θ≤110 degrees, preferably, 95 degrees≤θ≤110 degrees, as shown FIG. 10.

Subsequently, an experiment result of the angle θ shown in FIG. 10 will be considered. It is presumed that in the case where the projection 170 has a rectangular shape (rectangular parallelepiped shape), the angle θ formed between the side wall 177*a* having a greater area, among the four side walls 177*a*, 177*b*, 177*c*, and 177*d* of the projection 170, and the tip end surface 162 of the piston 122, is 90 degrees≤θ≤110 degrees, and thereby the working fluid 104 moves efficiently to the side walls 177*c* and 177*d* adjacent to the side wall 177*a*.

To be specific, as shown in FIG. 6, the working fluid 104 collides against the projection 170. However, the projection 170 has the four side walls 177*a*, 177*b*, 177*c*, and 177*d* which are flat surfaces and fundamentally has rectangular parallelepiped shape, and the projection center axis 175 of the projection 170 substantially conforms to the discharge hole center axis 174. This allows a disordered flow of the working fluid 104 flowing into the discharge hole 146 to be guided in a specified direction, i.e., axial direction of the discharge hole 146. In particular, by setting the angle θ formed between the side wall 177*a* having a greater area and facing the suction hole 144, and the tip end surface 162 of the piston 122, to 90 degrees≤θ≤110 degrees, a flow component guided toward the discharge hole 146 increases, in the working fluid 104 which collides against the side wall 177*a* of the projection 170.

To be specific, a particular flow of the working fluid 104 is formed by the first groove 168. The flow of the working fluid 104 which has collided against the side wall 177*a* (177*b*, 177*c*, 177*d*) of the projection 170 is faired with a greater amount to flow toward the discharge hole 146. The working fluid 104 which is in the vicinity of this flow is induced by this flow toward the discharge hole 146. Therefore, the working fluid 104 staying in the interior of the compression chamber 138 is reduced in amount, and re-expansion of the working fluid 104 staying in the combustion chamber 138 immediately before start of the suction step is lessened. It may be presumed that the coefficient of performance COP of the compressor can be improved effectively as a result of the above.

The above mentioned experimental result supports an idea that the efficiency of the compressor is affected by the angle θ formed between the side wall 177*a* of the projection 170 which is closest to the discharge hole center axis 174, among the four side walls 177*a*, 177*b*, 177*c*, and 177*d* of the projection 170, and the tip end surface 162 of the piston 122, in addition to a space (dead volume) formed when the piston 122 is in the top dead center, the shape of the discharge hole 146, and the shape of the projection 170 of the piston 122.

The experimental result of FIG. 10 relates to only the angle θ formed by the side wall 177*a*. Note that the coefficient of performance COP of the compressor can be improved more effectively by setting the angles θ formed by the side walls 177*b*, 177*c*, and 177*d* to an angle within the above range 90 degrees≤θ≤110 degrees.

If the angle θ formed between the side wall 177*a* and the tip end surface 162 of the piston 122 is set smaller than 90 degrees, the flow of the working fluid 104 to the discharge hole 146 is precluded, and the coefficient of performance COP decreases.

In the discharge step, the projection 170 is fitted into the discharge hole 146, and the volume of the compression chamber 138 including the volume of the discharge hole 146 in the state where the piston 122 is in the top dead center can be reduced. In this way, re-expansion amount can be reduced by further reducing the weight of the remaining working fluid 104. This makes it possible to achieve a higher volume efficiency.

In a case where the discharge hole 146 is positioned at the center portion of the tip end surface 162 of the piston 122, similar advantages can be achieved by providing the first groove 168 such that the first groove 168 extends from the outer peripheral edge portion 164 of the piston 122 where the working fluid 104 stays toward the location facing the discharge hole 146.

Figure 11A:
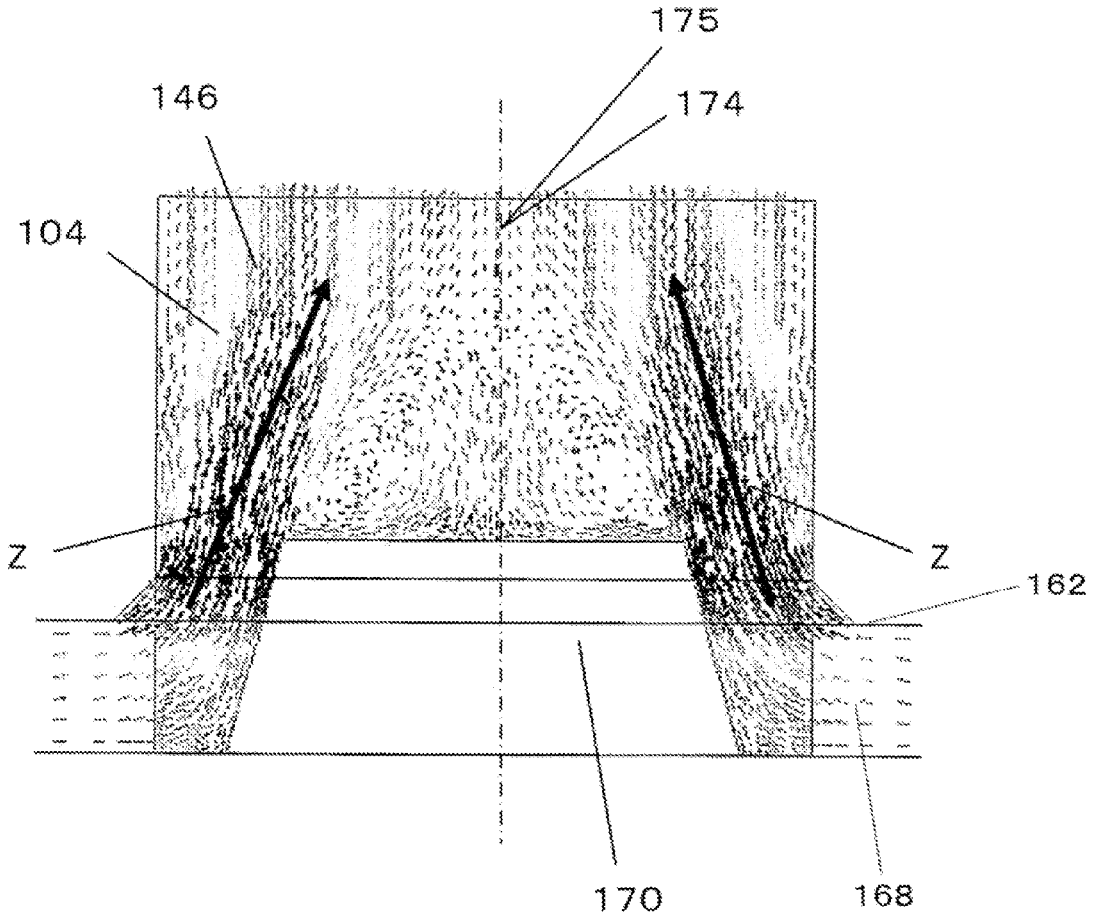
FIG. 11A is a diagram of a flow velocity vector of a working fluid behavior in the sealed compressor of Embodiment 1.
Figure 11B:
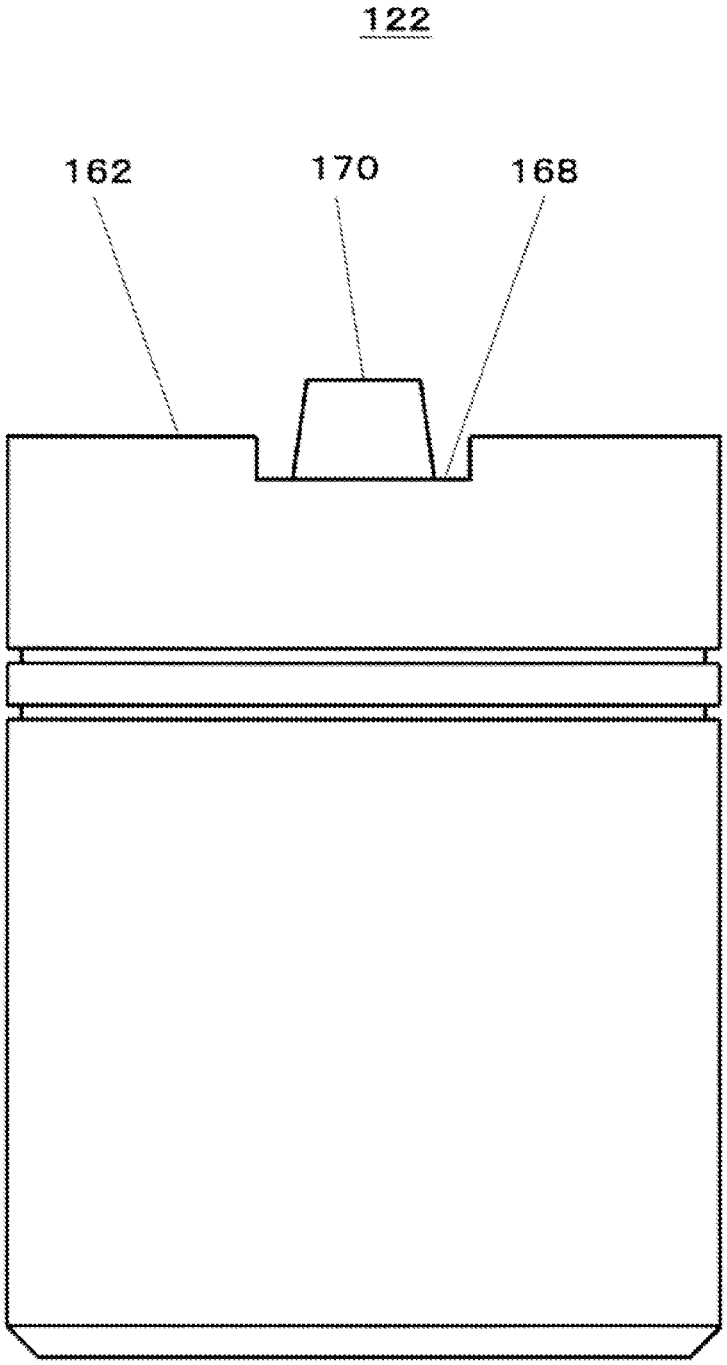
FIG. 11B is a front view of the piston of the sealed compressor of Embodiment 1.

Since the projection center axis 175 substantially conforms to the discharge hole center axis 174, the flow of the working fluid 107 is less likely to be precluded, and the volume efficiency can be further improved. Hereinafter, this will be described with reference to FIGS. 11A and 11B. FIG. 11A is a diagram of a flow velocity vector of a working fluid behavior in the sealed compressor of Embodiment 1. FIG. 11B is a front view of the piston of the sealed compressor of Embodiment 1.

Referring to FIG. 11A, the projection center axis 175 is made to substantially conform to the discharge hole center axis 174, and the projection 170 has a shape in which surfaces facing each other are symmetric in the direction in which the first groove 168 extends. With this configuration, the flow velocity of the working fluid 104 during the compression step can be made uniform along these surfaces as indicated by arrows Z, and the flow of the working fluid 104 is faired along the projection 170. This makes it possible to avoid that the flow of the working fluid 104 is precluded, and further improve the volume efficiency.

Referring to FIG. 11B, if the projection 170 is laterally symmetric when viewed from a center axis direction of the discharge hole 146, and the first groove 168 constituting the flow passage of the working fluid 104 is laterally symmetric with respect to the projection 170, the flow of the working fluid 104 can be made more smooth, and the volume efficiency can be further improved.

As used herein, the phrase "the first groove 168 is laterally symmetric with respect to the projection 170" is meant to include a structure in which the first groove is imperfectly laterally symmetric with respect to the projection 170. That is, the first groove 168 need not be laterally symmetric with respect to the projection 170 so long as the advantage of the present invention is achieved. For example, the first groove 168 may have a shape in which the width of the bottom surface of the first groove 168 at the left side of the projection 170, or the depth of the bottom surface of the first groove 168 at the left side of the projection 170 is smaller or greater than the width of the bottom surface of the first groove 168 at the right side of the projection 170, or the depth of the bottom surface of the first groove 168 at the right side of the projection 170, respectively, when viewed from the direction of the working fluid 104 flows (direction from the base end portion 168B of the first groove 168 toward the tip end portion 168A of the first groove 168) so long as the advantage of the present invention can be achieved.

Embodiment 2

Figure 12:
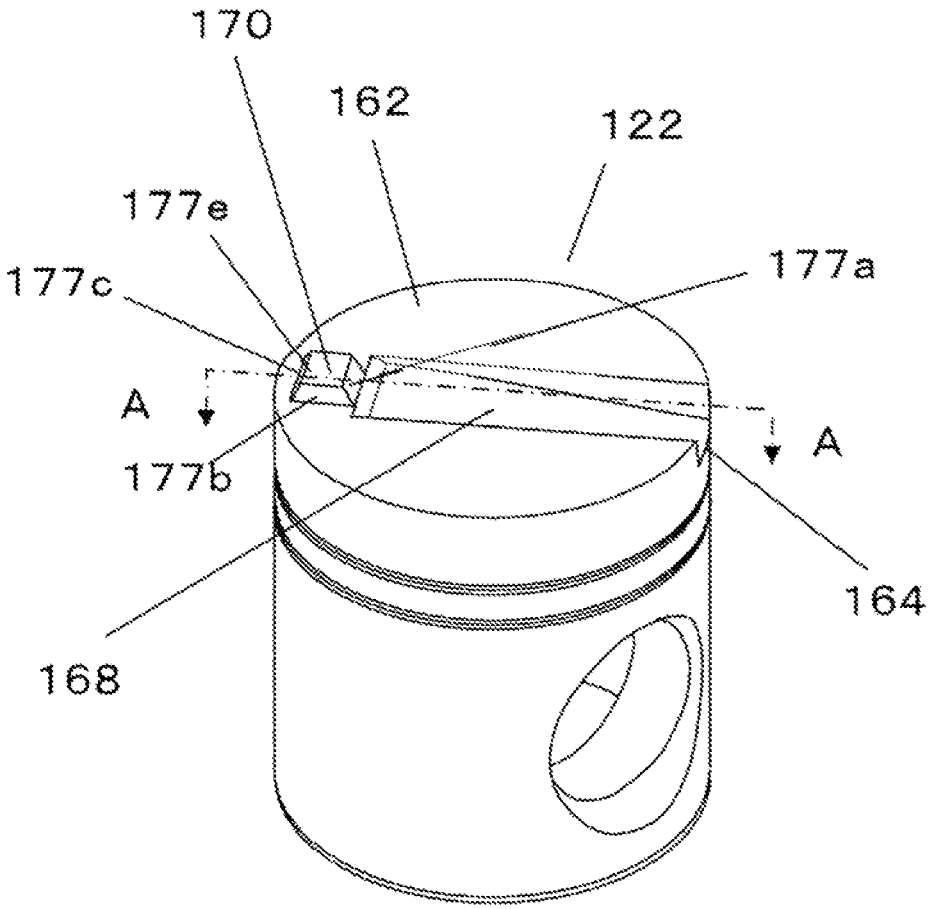
FIG. 12 is a perspective view of a piston constituting a compression element in a sealed compressor of Embodiment 2 of the present invention.
Figure 13:
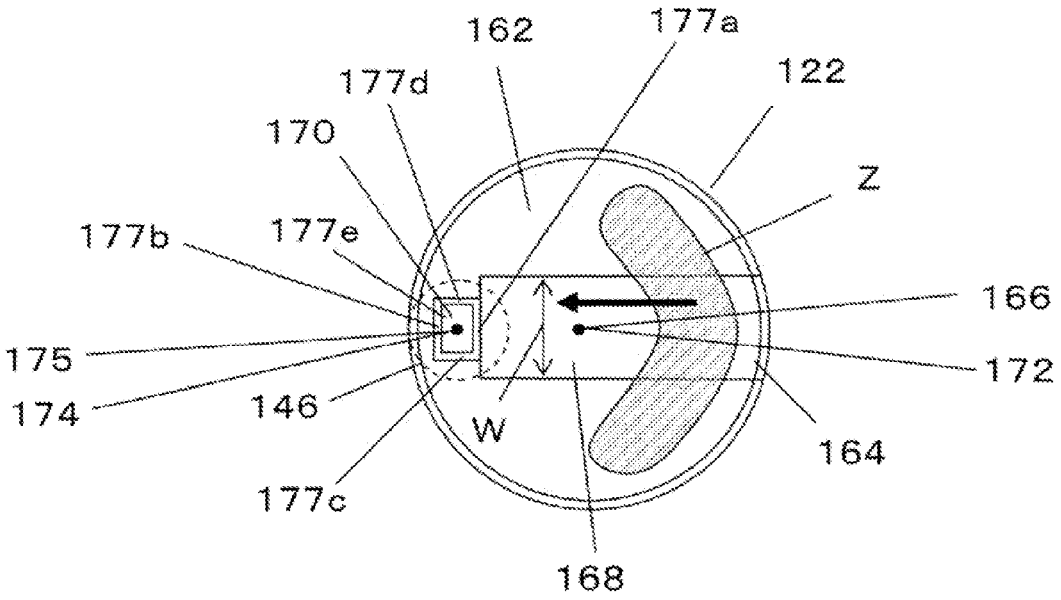
FIG. 13 is a plan view of a piston in the sealed compressor of Embodiment 2.
Figure 14:
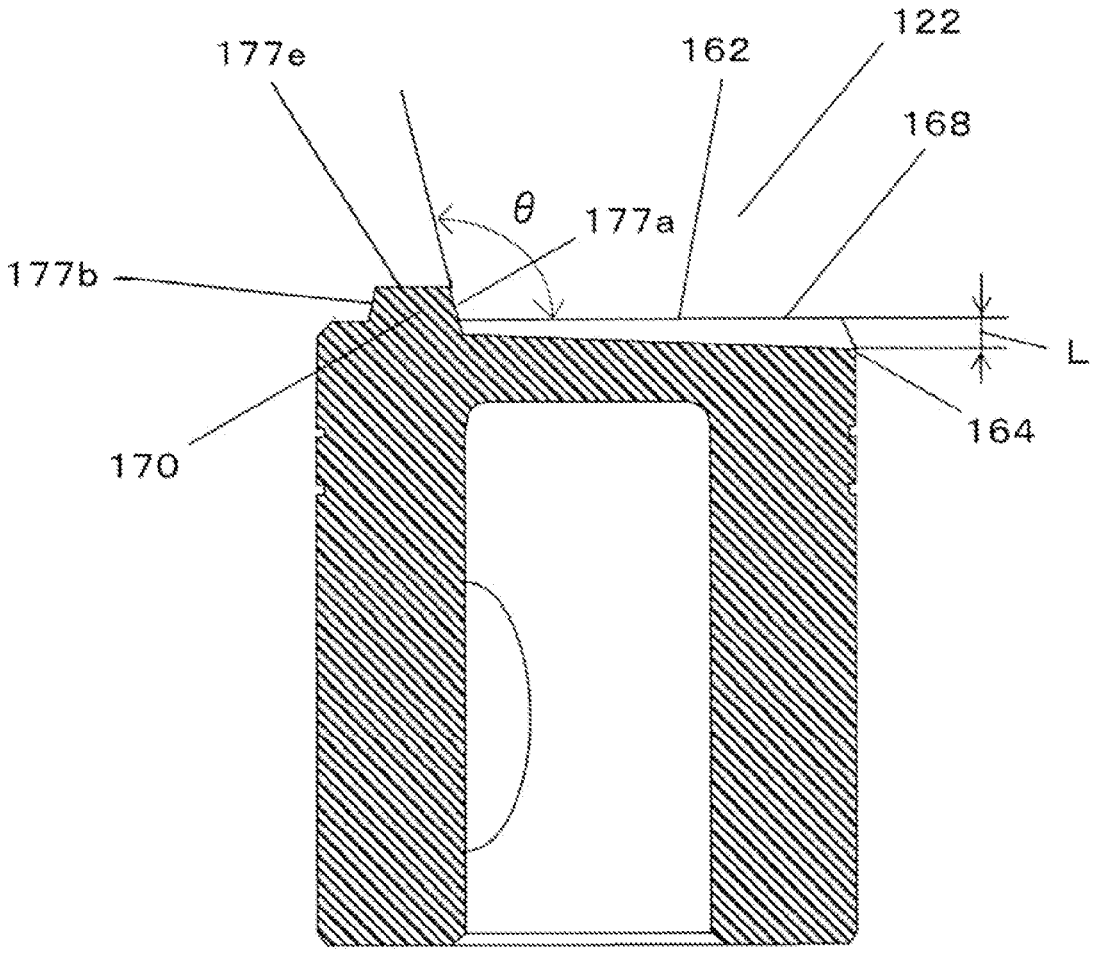
FIG. 14 is a longitudinal sectional view of the piston in the sealed compressor of Embodiment 2, taken along line A-A of FIG. 12.
Figure 15:
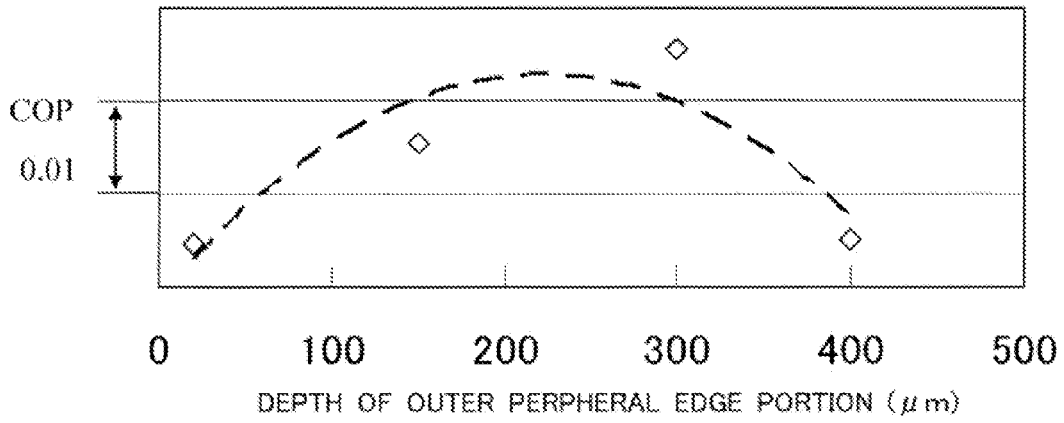
FIG. 15 is a view showing the relationship between a depth of an outer peripheral edge portion of a tip end surface of a piston and coefficient of performance COP, in the sealed compressor of Embodiment 2.

FIG. 12 is a perspective view of a piston constituting a compression element in a sealed compressor of Embodiment 2. FIG. 13 is a plan view of a piston in the sealed compressor of Embodiment 2 of the present invention. FIG. 14 is a longitudinal sectional view of the piston in the sealed compressor of Embodiment 2, taken along line A-A of FIG. 12. FIG. 15 is a view showing the relationship between a depth of an outer peripheral edge portion and coefficient of performance COP, in the sealed compressor of Embodiment 2.

Referring to FIGS. 12 and 13, the sealed compressor of Embodiment 2 of the present invention fundamentally has the same configuration as that of the sealed compressor of Embodiment 1, but is different from the same in a structure of the first groove 168.

To be specific, the bottom surface of the first groove 168 is inclined such that the bottom surface is away from the valve plate 148 in a direction from a portion of the tip end surface 162 of the piston 122 which faces the discharge hole 146, toward the outer peripheral edge portion 164. Based on an experimental result as described later, the first groove 168 has a shape in which a width W (see FIG. 13) is 5 mm, and a depth L (see FIG. 14) of the outer peripheral edge portion 164 (base end portion) is in a range of 10 μm to 500 μm. In Embodiment 2, the bottom surface of the first groove 168 is inclined with a constant inclination angle from the base end portion thereof to the tip end portion thereof. Because of this, the depth of the tip end portion of the first groove 168 is set to a depth of the inclined bottom surface of the first groove 168.

Subsequently, a description will be given of the relationship between the depth of the base end portion of the first groove 168 and the compression rate. FIG. 15 is a view showing the relationship between a depth of the base end portion of the first groove and coefficient of performance COP, in the sealed compressor of Embodiment 2.

Referring to FIG. 15, it was suggested that when the first groove 168 has a width of 5 mm, the tip end portion of the first groove 168 has a constant depth, and the base end portion of the first groove 168 has a depth of 10 μm to 500 μm, the working fluid 104 is guided efficiently to the projection 170. Therefore, as described above, a depth L of the base end portion of the first groove 168 is suitably set to not less than 10 μm and not greater than 500 μm.

The sealed compressor of Embodiment 2 configured as described above can achieve the advantages as those of the sealed compressor of Embodiment 1. In Embodiment 2, since the bottom surface of the first groove 168 is inclined, the working fluid 104 is guided to the discharge hole 146 more smoothly along the inclined bottom surface.

Although in Embodiment 2, the depth L of the base end portion of the first groove 168 is suitably set to not less than 10 μm and not greater than 500 μm, it may be set to not less than 200 μm and not greater than 500 μm, in view of the experimental result of Embodiment 1.

Figure 16:
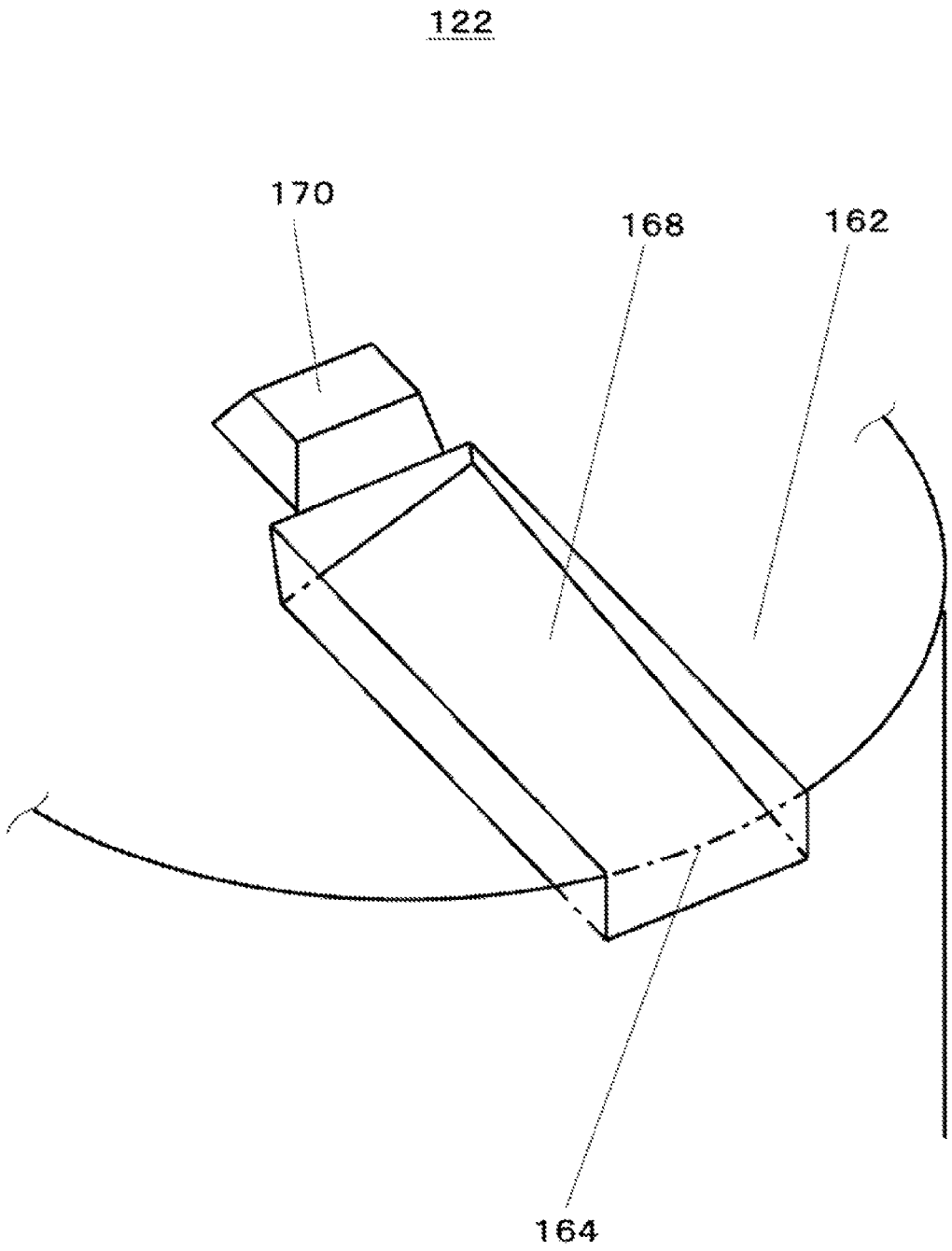
FIG. 16 is a perspective view showing a schematic configuration of a piston of a sealed compressor.

Although in Embodiment 2, the tip end portion of the first groove 168 has a constant depth, it may be configured not to have a constant depth so long as the advantages of the present invention can be achieved. FIG. 16 is a perspective view showing a schematic configuration of a piston of a sealed compressor, in which the tip end portion of the first groove 168 does not have a constant depth. In FIG. 16, a part of the configuration is omitted.

Referring to FIG. 16, as an example in which the tip end portion of the first groove 168 does not have a constant depth, the depth of the bottom surface of the first groove 168 at the left side of the projection 170 is greater than the depth of the bottom surface of the first groove 168 at the right side of the projection 170, when viewed from the direction in which the fluid flows (direction from the base end portion of the first groove 168 to the tip end portion of the first groove 168).

Although in Embodiment 2, the tip end portion of the first groove 168 has a constant depth, the base end portion of the first groove 168 may be configured not to have a constant depth, so long as the advantages of the present invention can be achieved.

Embodiment 3

Figure 17:
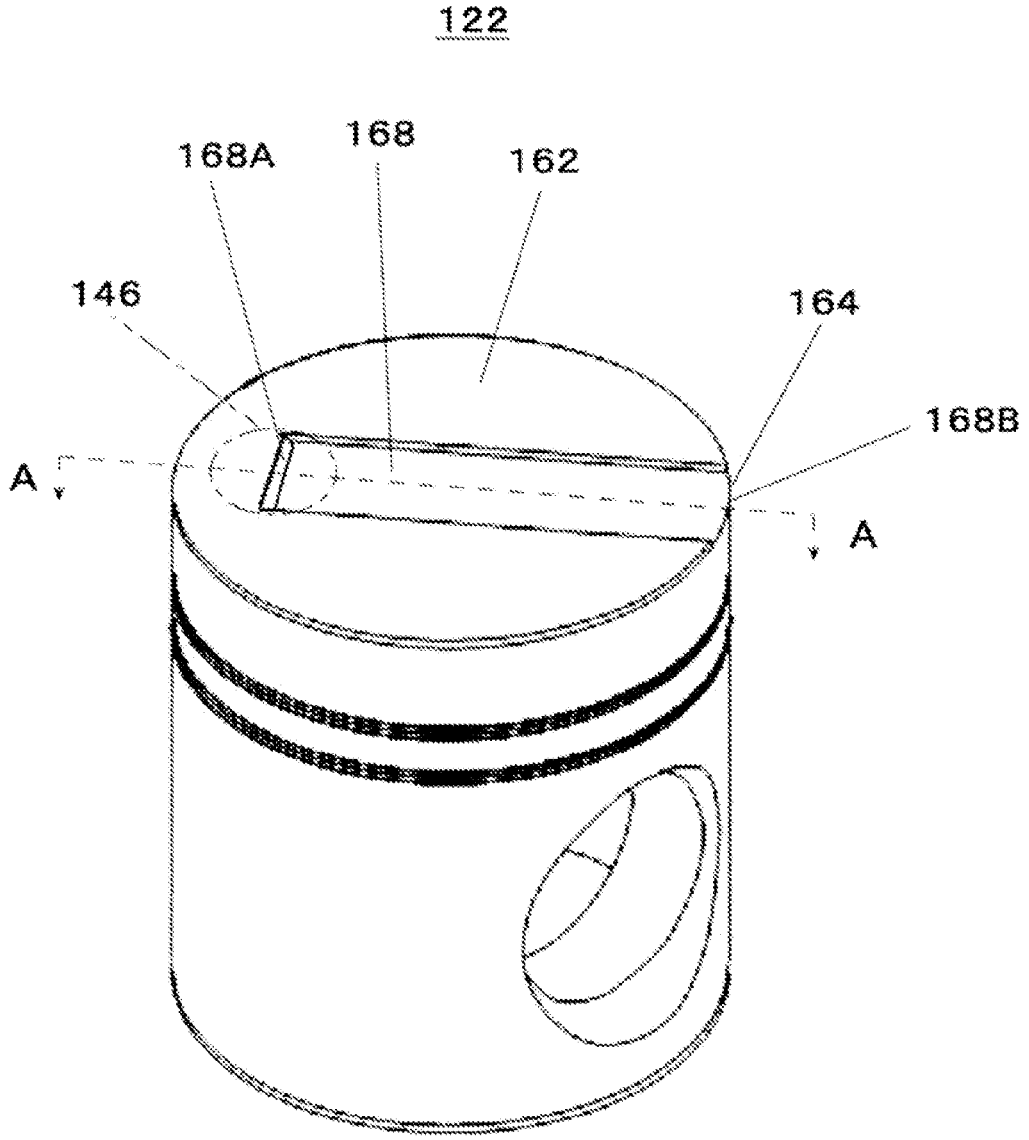
FIG. 17 is a perspective view of a piston constituting a compression element in a sealed compressor of Embodiment 3 of the present invention.
Figure 18:
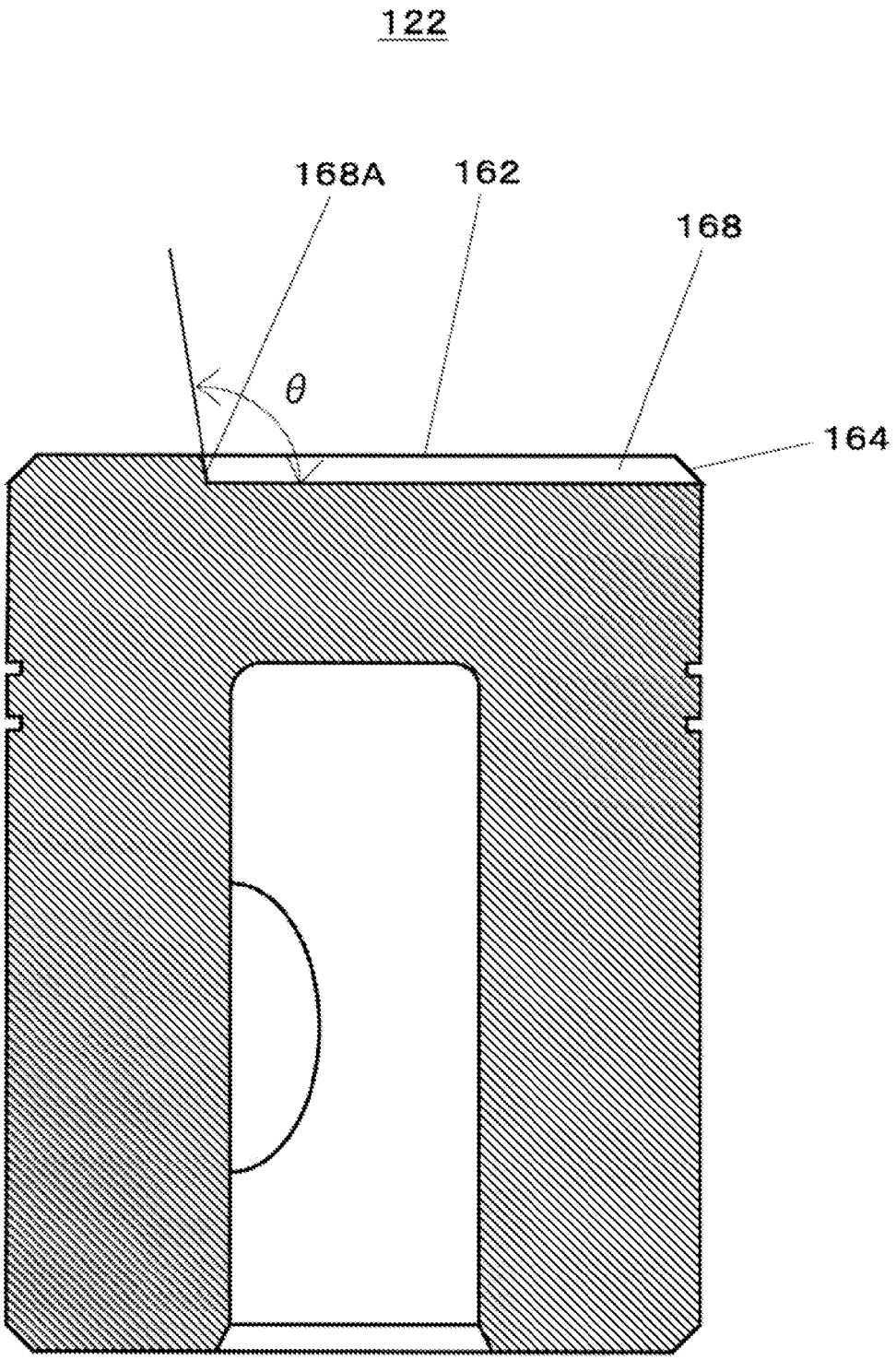
FIG. 18 is a longitudinal sectional view of the piston in the sealed compressor of Embodiment 3, taken along line A-A of FIG. 17.

FIG. 17 is a perspective view of a piston constituting a compression element in a sealed compressor of Embodiment 3 of the present invention. FIG. 18 is a longitudinal sectional view of the piston in the sealed compressor of Embodiment 3, taken along line A-A of FIG. 17.

Referring to FIGS. 17 and 18, the sealed compressor of Embodiment 3 of the present invention fundamentally has the same configuration as that of the sealed compressor of Embodiment 1, but is different from the same in that a structure of the first groove 168 is different and the projection 170 is not provided.

To be specific, the first groove 168 has a band shape extending linearly from the outer peripheral edge portion 164 of the tip end surface 162 toward a portion of the tip end surface 162 which faces the discharge hole 146, and a tip end portion 168A of the first groove 168 is inclined. The tip end portion 168A of the first groove 168 is positioned on the portion of the tip end surface 162 which faces the discharge hole 146. A base end portion 168B of the first groove 168 is positioned on a portion of the outer peripheral portion of the tip end surface 162 which is most distant in a diameter direction of the piston 122 from the portion of the tip end surface 162 which faces the discharge hole 146.

To allow the working fluid 104 to flow easily toward the discharge hole 146, the width of the first groove 168 is preferably set to not less than 10% of the diameter of the tip end surface 162 of the piston 122, and may be set to not less than 2 mm for the same purpose. To allow the working fluid 104 to flow easily in the first groove 168, the width of the first groove 168 is preferably set to not greater than 30% of the diameter of the tip end surface 162, and may be set to not greater than 6 mm. The depth of the first groove 168 is preferably set to not less than 20 μm and not greater than 60 μm, and is constant, as described above.

As shown in FIG. 18, the first groove 168 has a shape in which the angle θ formed between the inclined surface forming the tip end portion 168A and the tip end surface 162 is preferably not less than 90 degrees and not greater than 110 degrees and more preferably not less than 95 degrees and not greater than 110 degrees. This allows the working fluid 104 to flow easily toward the discharge hole 146 as described above, as described in Embodiment 1. That is, the working fluid 104 which has flowed from the base end portion 168B toward the tip end portion 168A of the first groove 168 is allowed to flow easily toward the discharge hole 146 by the inclined surface forming the tip end portion 168A. This can lessen the amount of the working fluid 104 remaining in the compression chamber 138.

The sealed compressor of Embodiment 3 configured as described above can achieve the advantages as those of the sealed compressor of Embodiment 1.

Embodiment 4

Figure 19:
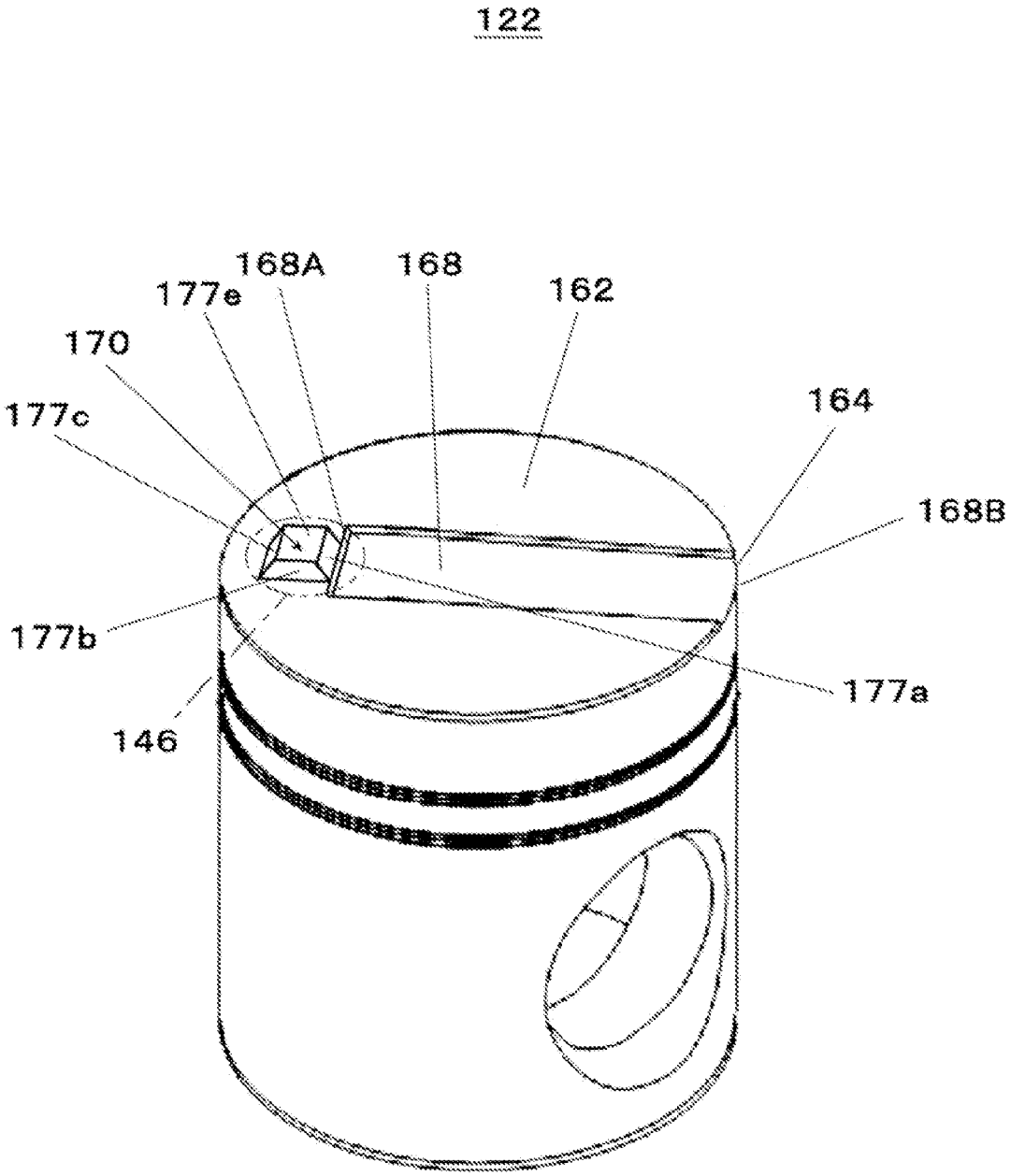
FIG. 19 is a perspective view of a piston constituting a compression element in a sealed compressor of Embodiment 4 of the present invention.

FIG. 19 is a perspective view of a piston constituting a compression element in a sealed compressor of Embodiment 4 of the present invention. Referring to FIG. 19, the sealed compressor of Embodiment 4 of the present invention fundamentally has the same configuration as that of the sealed compressor of Embodiment 1, but is different from the same in a structure of the first groove 168 and a structure of the projection 170. To be specific, the first groove 168 of the sealed compressor of Embodiment 4 is configured like the first groove 168 of the sealed compressor of Embodiment 3. Therefore, the first groove 168 will not be described in detail.

The projection 170 of the sealed compressor of Embodiment 4 is different from the projection 170 of the sealed compressor of Embodiment 1 in that the projection 170 of the sealed compressor of Embodiment 4 is provided in a portion of the tip end surface 162 which faces the discharge hole 146. Like Embodiment 1, the projection 170 is inserted into the discharge hole 146 of the valve plate 148 when the piston 122 is in the top dead center.

The sealed compressor of Embodiment 4 configured as described above can achieve the advantages as those of the sealed compressor of Embodiment 1.

Embodiment 5

Figure 20:
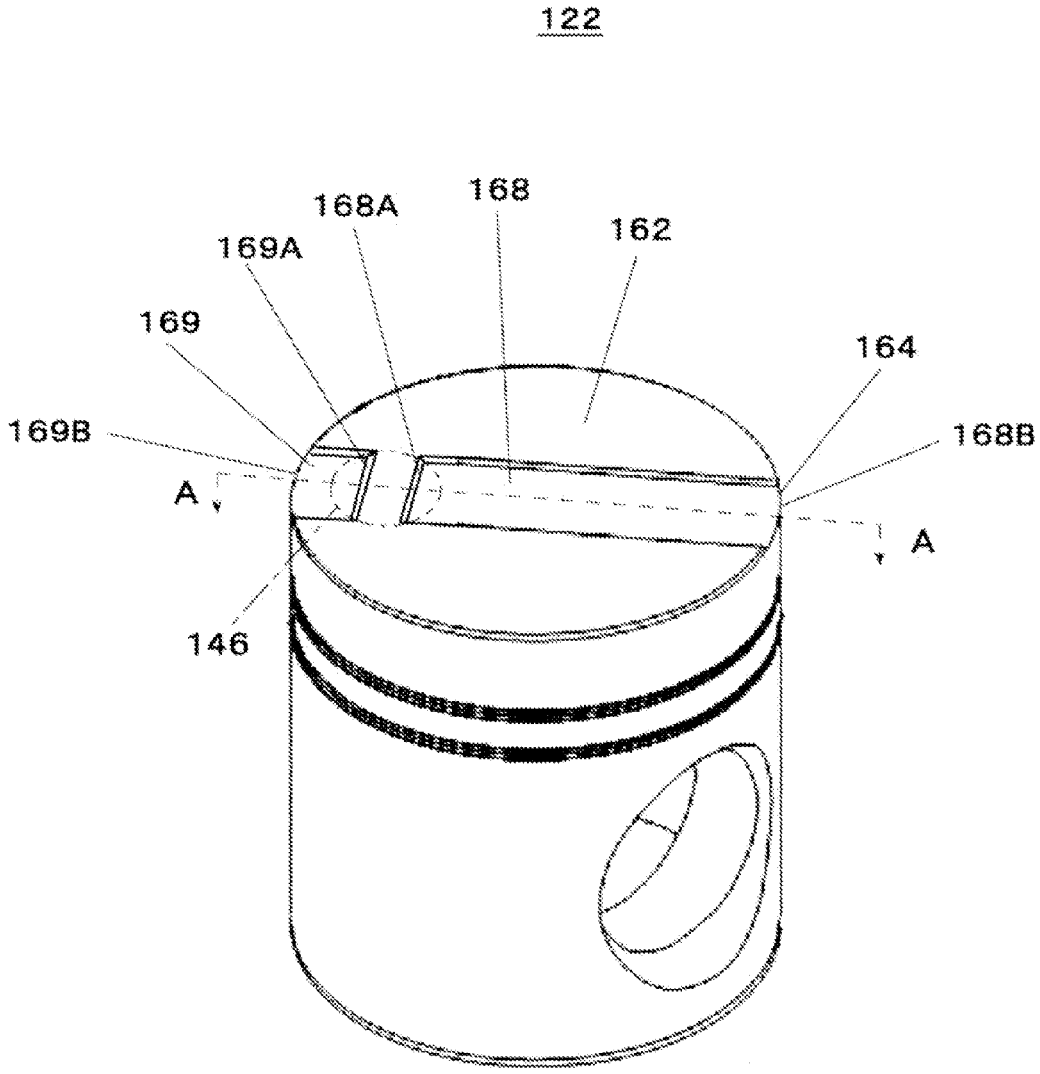
FIG. 20 is a perspective view of a piston constituting a compression element in a sealed compressor of Embodiment 5 of the present invention.
Figure 21:
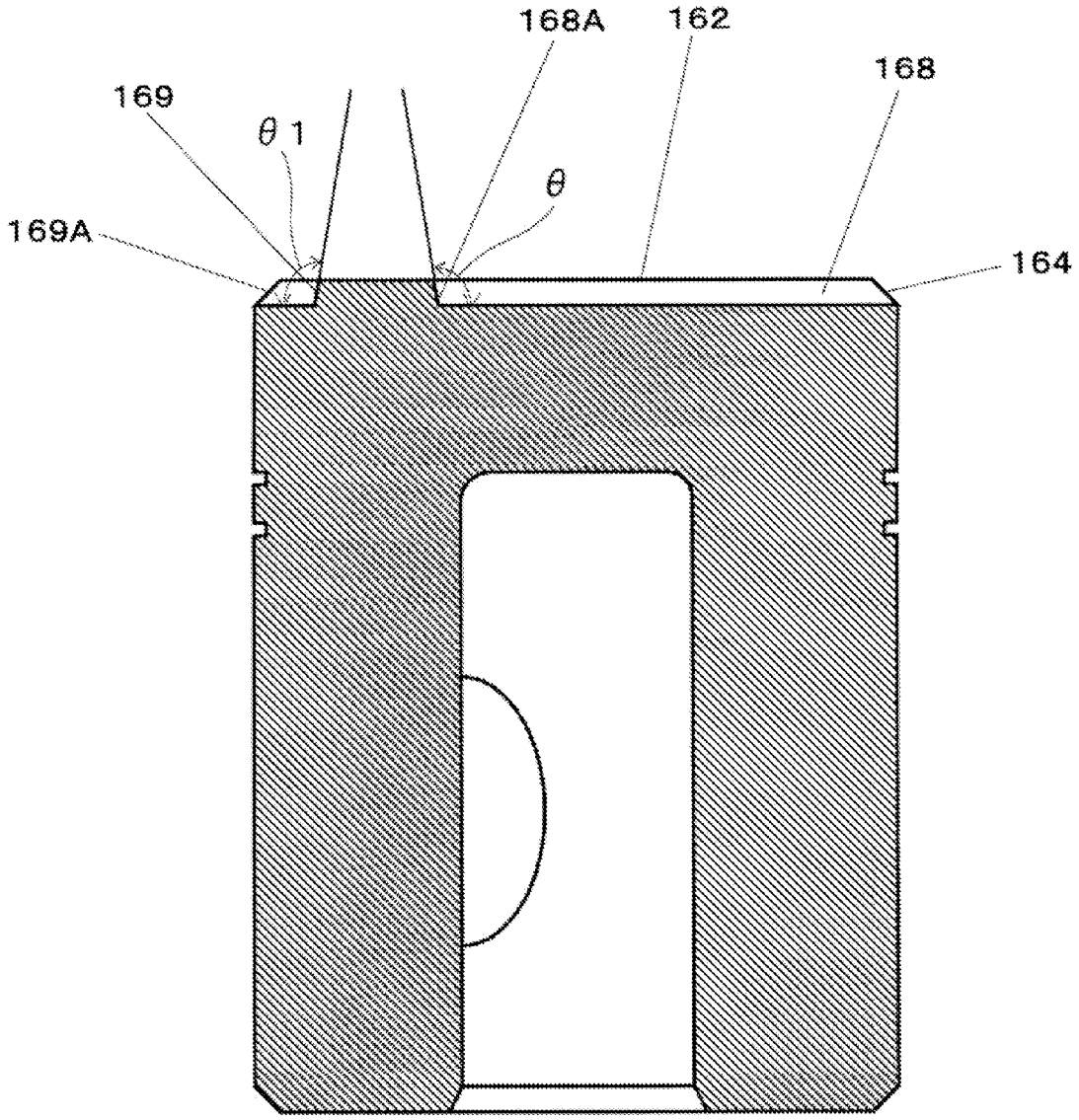
FIG. 21 is a longitudinal sectional view of the piston in the sealed compressor of Embodiment 5, taken along line A-A of FIG. 20.
Figure 22:
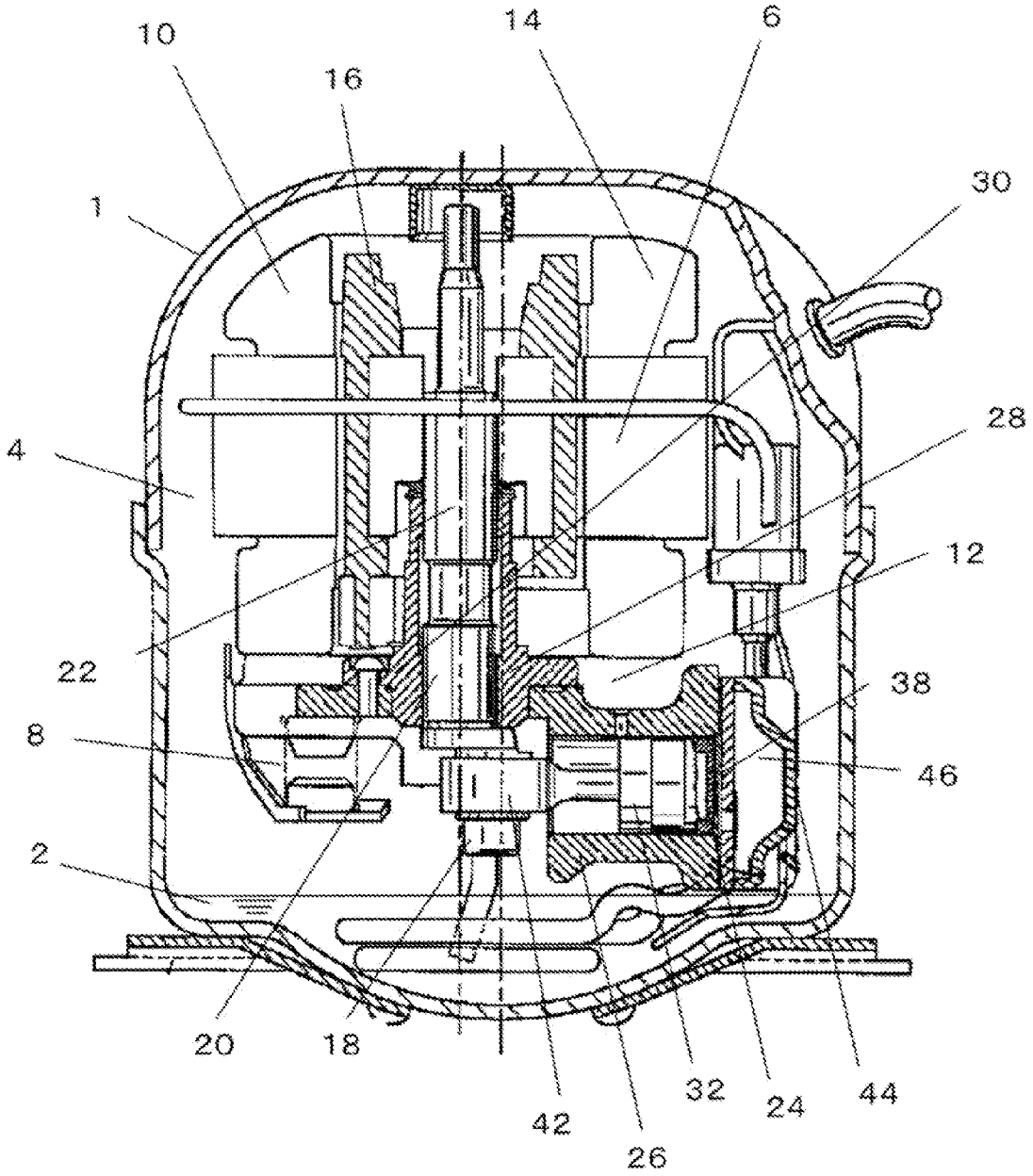
FIG. 22 is a longitudinal sectional view of a conventional sealed compressor disclosed in Japanese Examined Patent Application Publication No. Hei. 8-6689.
Figure 23:
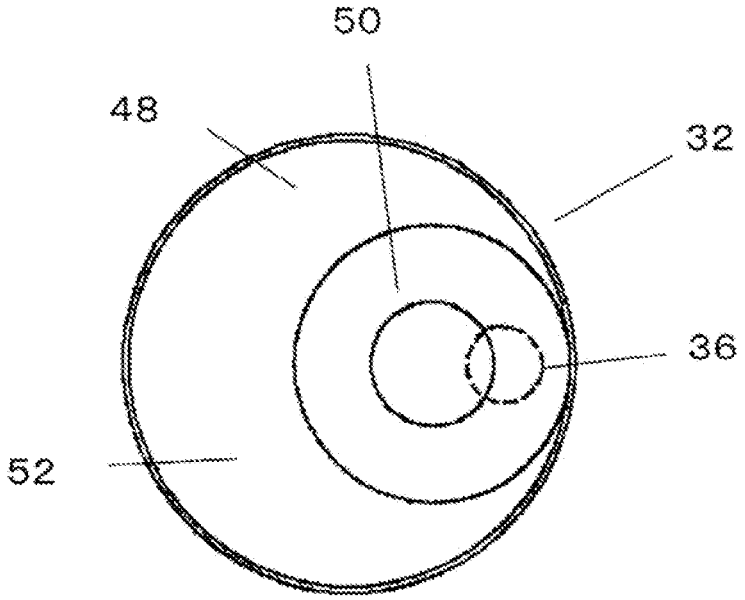
FIG. 23 is a plan view of a piston of a conventional sealed compressor when viewed from a tip end surface side.
Figure 24:
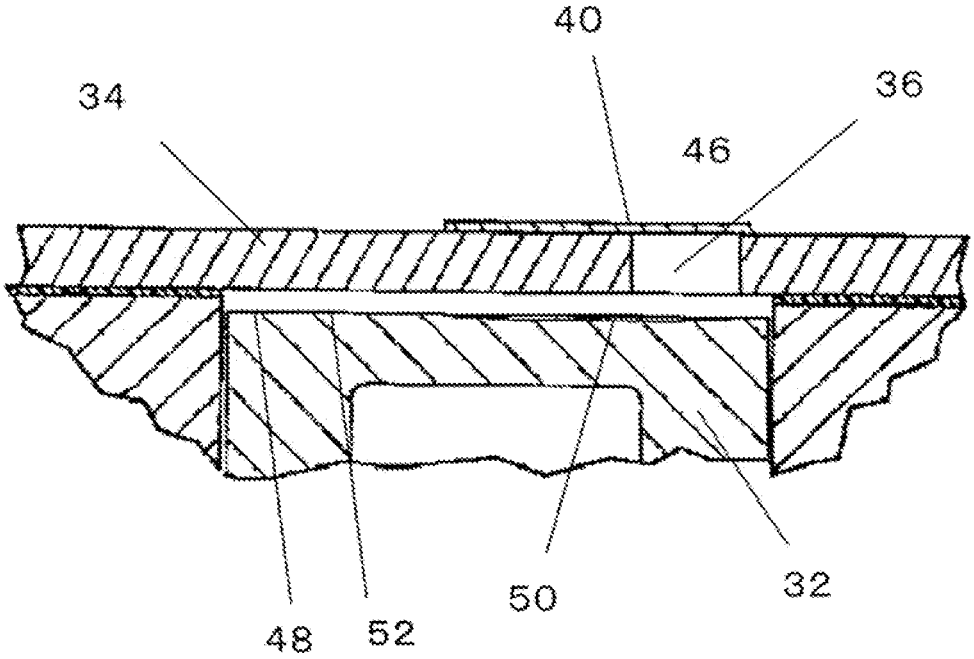
FIG. 24 is an enlarged cross-sectional view of major components of the upper portion of a piston and a valve plate portion in the conventional sealed compressor.

FIG. 20 is a perspective view of a piston constituting a compression element in a sealed compressor of Embodiment 5 of the present invention. FIG. 21 is a longitudinal sectional view of the piston in the sealed compressor of Embodiment 5, taken along line A-A of FIG. 20.

Referring to FIGS. 20 and 21, the sealed compressor of Embodiment 5 of the present invention fundamentally has the same configuration as that of the sealed compressor of Embodiment 1, but is different from the same in that a structure of the first groove 168 is different, the projection 170 is not provided, and a second groove 169 is provided.

To be specific, the first groove 168 of the scaled compressor of Embodiment 5 is configured like the first groove 168 of the sealed compressor of Embodiment 3. Therefore, detailed description of the first groove 168 will be omitted.

The second groove 169 has a band shape extending from the outer peripheral portion 164 of the tip end surface 162 toward the portion of the tip end surface 162 which faces the discharge hole 146, and a tip end portion 169 A of the second groove 169 is inclined. The tip end portion 169A of the second groove 169 is located on the portion of the tip end surface 162 which faces the discharge hole 146. A base end portion 169B of the second groove 169 is most distant from the base end portion 168B of the first groove 168. In other words, the second groove 169 faces the first groove 168 such that the portion of the tip end surface 162 which face the discharge hole 146 is sandwiched between the first groove 168 and the second groove 169.

To allow the working fluid 104 to flow easily toward the discharge hole 146, the width of the second groove 169 is preferably set to not less than 10% of the diameter of the tip end surface 162 of the piston 122, and may be set to not less than 2 mm for the same purpose. To allow the working fluid 104 to flow easily in the second groove 169, the width of the second groove 169 is preferably set to not greater than 30% of the diameter of the tip end surface 162, and may be set to not greater than 6 mm. The depth of the second groove 169 is preferably set to not less than 20 μm and not greater than 60 μm, as described above. The width of the first groove 168 may be equal to or different from the width of the second groove 169. Likewise, the depth of the first groove 168 may be equal to or different from the depth of the second groove 169.

As shown in FIG. 21, the second groove 169 has a shape in which an angle θ1 formed between the inclined surface forming the tip end portion 169A and the tip end surface 162 is preferably not less than 90 degrees and not greater than 110 degrees and more preferably not less than 95 degrees and not greater than 110 degrees. This allows the working fluid 104 to flow easily toward the discharge hole 146, as described in Embodiment 1. That is, the working fluid 104 which has flowed from the base end portion 169B toward the tip end portion 169A of the second groove 169 is allowed to flow easily toward the discharge hole 146 by the inclined surface forming the tip end portion 169A. This can lessen the amount of the working fluid 104 left in the compression chamber 138.

The scaled compressor of Embodiment 5 configured as described above can achieve the advantages as those of the sealed compressor of Embodiment 1.

As described above, the sealed compressor of the present invention can improve a volume efficiency and a compressor efficiency. Therefore, the sealed compressor of the present invention is widely incorporated into air conditioners, automatic vending machines, other refrigerators, industrial compressors such as air compressors, etc., in addition to electric refrigerator-freezer for household use.

Numeral modifications and alternative embodiments of the present invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

What is claimed is:

1. A sealed compressor comprising:

an electric element;

a compression element driven by the electric element; and a sealed container accommodating the electric element and the compression element;

wherein the compression element includes a cylinder block defining a compression chamber; a piston which is reciprocatable inside the compression chamber; and a valve plate disposed to close an opening end of the compression chamber and having a discharge hole which provides communication between inside and outside of the compression chamber;

the piston has a first groove on a tip end surface thereof which faces the valve plate, the first groove having a predetermined width and extending from an outer peripheral edge portion of the tip end surface toward a portion of the tip end surface which faces the discharge hole;

the piston is provided with a projection having a top surface, on the tip end surface of the piston which faces the valve plate;

the projection is positioned in the portion of the tip end surface which faces the discharge hole;

the projection is inserted into the discharge hole of the valve plate in a state where the piston is at a top dead center, the projection has a flat surface facing a flow of a working fluid, an angle θ formed between the tip end surface of the piston and the flat surface of the projection protruding from the tip end surface is equal to or larger than 95 degrees and equal to or smaller than 110 degrees; and a ratio of an area of the top surface of the projection with respect to an area of a bottom surface of the projection, the bottom surface being connected to the tip end surface of the piston, is in a range of 0.2 to 0.75;

a ratio of an area of the bottom surface of the projection with respect to an area of an opening of the discharge hole is set to a value in a range of 0.3 to 0.6; and a ratio of a height of the projection with respect to a thickness of the valve plate is set to a value in a range of 0.65 to 0.75.

2. The sealed compressor according to claim 1, wherein the tip end surface of the piston has a circular shape; and the predetermined width of the first groove is not less than 10% of a diameter of the piston and not greater than 30% of the diameter of the piston.

3. The sealed compressor according to claim 1, wherein the piston has a second groove on the tip end surface thereof which faces the valve plate, the second groove having a predetermined width and extending from the outer peripheral edge portion of the tip end surface toward the portion of the tip end surface which faces the discharge hole; and a base end portion of the second groove is most distant from a base end portion of the first groove;

a tip end portion of the second groove is positioned in the portion of the tip end surface which faces the discharge hole and is inclined.

4. The sealed compressor according to claim 3, wherein the first groove and the second groove communicate with each other.

5. The sealed compressor according to claim 4, wherein the projection has a pair of side walls which are parallel to a direction in which the first groove extends.

6. The sealed compressor according to claim 1, wherein the projection has a center axis conforming to a center axis of the discharge hole.

7. The sealed compressor according to claim 1, wherein the first groove extends along a diameter of the piston which passes through the portion of the tip end surface which faces the discharge hole; and a base end portion of the first groove is positioned on a portion of the outer peripheral edge portion which is distant from the portion of the tip end surface which faces the discharge hole.

8. The sealed compressor according to claim 1, wherein the first groove has a shape in which an angle formed between an inclined surface forming a tip end portion and the tip end surface of the piston is not less than 90 degrees and not greater than 110 degrees.

9. The sealed compressor according to claim 8, wherein the projection protrudes from the tip end surface of the piston along the inclined surface forming the tip end portion of the first groove.

10. The sealed compressor according to claim 8, wherein the predetermined width of the first groove is not less than 2 mm and not greater than 6 mm, and a portion of the first groove which is other than the tip end portion has a depth which is not less than 20 μm and not greater than 60 μm.

11. The sealed compressor according to claim 1, wherein the first groove has a shape in which a bottom surface thereof is inclined to have a depth decreasing from a base end portion thereof toward a tip end portion.

12. The sealed container according to claim 11, wherein the first groove has a shape in which the base end portion has a depth which is not less than 10 μm and not greater than 500 μm.

13. The sealed compressor according to claim 1, wherein the ratio of the area of the top surface of the projection with respect to the area of the bottom surface of the projection is in a range of 0.5 to 0.75.

14. The sealed compressor according to claim 1, wherein the top surface of the projection is planar.

15. The sealed compressor according to claim 1, wherein the first groove has an inclined surface forming a tip end portion of the first groove; and the predetermined width of the first groove is not less than 2 mm and not greater than 6 mm, and a portion of the first groove which is other than the tip end portion has a depth which is not less than 20 μm and not greater than 60 μm.

* * * * *